US008218983B2

(12) United States Patent
Takano

(10) Patent No.: US 8,218,983 B2
(45) Date of Patent: Jul. 10, 2012

(54) IMAGE FORMATION APPARATUS INCLUDING HOT-ROLL TYPE FIXING DEVICE AND METHOD FOR DETERMINING MALFUNCTION OF TEMPERATURE SENSOR IN THE SAME

(75) Inventor: Masahito Takano, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 856 days.

(21) Appl. No.: 12/237,140

(22) Filed: Sep. 24, 2008

(65) Prior Publication Data

US 2009/0080928 A1 Mar. 26, 2009

(30) Foreign Application Priority Data

Sep. 25, 2007 (JP) ..... 2007-247244

(51) Int. Cl.
*G03G 15/20* (2006.01)

(52) U.S. Cl. ..... 399/33; 399/69

(58) Field of Classification Search ..... 399/33, 399/69, 67; 219/216
See application file for complete search history.

(56) References Cited

U.S. PATENT DOCUMENTS

| | | | | |
|---|---|---|---|---|
| 7,062,187 | B2 | 6/2006 | Peng et al. | |
| 2002/0186982 | A1 * | 12/2002 | Tamaoki | 399/69 |
| 2007/0122173 | A1 * | 5/2007 | Mitsuoka et al. | 399/69 |

FOREIGN PATENT DOCUMENTS

| | | | |
|---|---|---|---|
| JP | 5-100591 | | 4/1993 |
| JP | 7-77892 | | 3/1995 |
| JP | 2000-259033 | A | 9/2000 |
| JP | 2000-259035 | A | 9/2000 |
| JP | 2003-257951 | | 9/2003 |
| JP | 2004-151471 | A | 5/2004 |
| JP | 2004-205570 | A | 7/2004 |
| JP | 2004-219619 | A | 8/2004 |
| JP | 2004-252431 | A | 9/2004 |
| JP | 2004-361715 | A | 12/2004 |
| JP | 2006-47411 | A | 2/2006 |
| JP | 2007-47126 | | 2/2007 |

OTHER PUBLICATIONS

Machine translation of JP 05-100591 A dated Jun. 30, 2011.*
Japanese Decision to Grant Patent mailed on Feb. 9, 2010, directed to counterpart Japanese Patent Application No. 2007-247244; 6 pages.
Japanese Office Action mailed on Jul. 28, 2009 directed to counterpart application No. 2007-247244;7 pages.

* cited by examiner

*Primary Examiner* — Sophia S Chen
(74) *Attorney, Agent, or Firm* — Morrison & Foerster LLP

(57) ABSTRACT

A control portion determines whether a malfunction occurs or not in a roller temperature sensor and an ambient temperature sensor by comparing a trajectory (temporal behavior) actually created by two-dimensional data on a temperature table with a target trajectory. In other words, the control portion successively integrates a prescribed weight for each transition from one element to the adjacent element corresponding to a trajectory of two-dimensional data on the temperature table, and determines whether or not a malfunction occurs in the roller temperature sensor and the ambient temperature sensor, based on the integrated weight.

16 Claims, 17 Drawing Sheets

FIG.3

651

| | | DIFFERENTIAL STEP | | | | | | | |
|---|---|---|---|---|---|---|---|---|---|
| | | 0 | 1 | 2 | 3 | 4 | 5 | 6 | 7 |
| COMPENSATION STEP | 0 | 160 | 170 | 180 | 200 | 210 | 220 | 230 | 240 |
| | 1 | 140 | 150 | 160 | 180 | 200 | 210 | 220 | 230 |
| | 2 | 120 | 125 | 130 | 145 | 180 | 200 | 210 | 220 |
| | 3 | 90 | 100 | 120 | 130 | 160 | 180 | 200 | 210 |
| | 4 | 60 | 80 | 90 | 120 | 140 | **170** → | **180** | 200 |
| | 5 | 40 | 60 | 80 | **110** → | **130** | 160 | 180 | 200 |
| | 6 | 20 → | **40** → | **70** | 130 | 170 | 180 | 200 | 220 |
| | 7 | 0 | 30 | 90 | 160 | 180 | 200 | 220 | 230 |

FIG.4A

| | | DIFFERENTIAL STEP | | | | | | | |
|---|---|---|---|---|---|---|---|---|---|
| | | 0 | 1 | 2 | 3 | 4 | 5 | 6 | 7 |
| COMPENSATION STEP | 0 | 160 | 170 | 180 | 200 | 210 | 220 | 230 | 240 |
| | 1 | 140 | 150 | 160 | 180 | 200 | 210 | 220 | 230 |
| | 2 | 120 | 125 | 130 | 145 | 180 | 200 | 210 | 220 |
| | 3 | 90 | 100 | 120 | 130 | 160 | 180 | 200 | 210 |
| | 4 | 60 | 80 | 90 | 120 | 140 | **170** | **180** | 200 |
| | 5 | 40 | 60 | 80 | **110** | **130** | 160 | 180 | 200 |
| | 6 | 20 | **40** | **70** | 130 | 170 | 180 | 200 | 220 |
| | 7 | 0 | 30 | 90 | 160 | 180 | 200 | 220 | 230 |

FIG.4B

| | | DIFFERENTIAL STEP | | | | | | | |
|---|---|---|---|---|---|---|---|---|---|
| | | 0 | 1 | 2 | 3 | 4 | 5 | 6 | 7 |
| COMPENSATION STEP | 0 | 160 | 170 | 180 | 200 | 210 | 220 | 230 | 240 |
| | 1 | 140 | 150 | 160 | 180 | 200 | 210 | 220 | 230 |
| | 2 | 120 | 125 | 130 | 145 | 180 | 200 | 210 | 220 |
| | 3 | 90 | 100 | 120 | 130 | 160 | 180 | 200 | 210 |
| | 4 | 60 | 80 | 90 | 120 | **140** | **170** | **180** | **200** |
| | 5 | 40 | 60 | **80** | **110** | 130 | 160 | 180 | 200 |
| | 6 | 20 | **40** | 70 | 130 | 170 | 180 | 200 | 220 |
| | 7 | 0 | 30 | 90 | 160 | 180 | 200 | 220 | 230 |

FIG.4C

| | | DIFFERENTIAL STEP | | | | | | | |
|---|---|---|---|---|---|---|---|---|---|
| | | 0 | 1 | 2 | 3 | 4 | 5 | 6 | 7 |
| COMPENSATION STEP | 0 | 160 | 170 | 180 | 200 | 210 | 220 | 230 | 240 |
| | 1 | 140 | 150 | 160 | 180 | 200 | 210 | 220 | 230 |
| | 2 | 120 | 125 | 130 | 145 | 180 | 200 | 210 | 220 |
| | 3 | 90 | 100 | 120 | 130 | 160 | 180 | 200 | 210 |
| | 4 | 60 | 80 | 90 | 120 | **140** | *170* | *180* | 200 |
| | 5 | 40 | 60 | **80** | *110* | *130* | 160 | 180 | 200 |
| | 6 | *20* | *40* | *70* | 130 | 170 | 180 | 200 | 220 |
| | 7 | 0 | 30 | 90 | 160 | 180 | 200 | 220 | 230 |

DIFFERENT PORTION

T[6][0] 653

| | | |
|---|---|---|
| — | 2[s] | 3[s] |
| — | — | 1[s] |
| — | 4[s] | 5[s] |

FIG.16

| | | SENSING STEP | | | | | | | |
|---|---|---|---|---|---|---|---|---|---|
| | | 0 | 1 | 2 | 3 | 4 | 5 | 6 | 7 |
| COMPENSATION STEP | 0 | 240 | 230 | 220 | 210 | 200 | 180 | 170 | 160 |
| | 1 | 230 | 220 | 210 | 200 | 180 | 160 | 150 | 140 |
| | 2 | 220 | 210 | 200 | 180 | 145 | 130 | 125 | 120 |
| | 3 | 210 | 200 | 180 | 160 | 130 | 120 | 100 | 90 |
| | 4 | 200 | **180** | **170** | 140 | 120 | 90 | 80 | 60 |
| | 5 | 180 | 150 | 160 | **130** | **110** | 80 | 60 | 40 |
| | 6 | 160 | 140 | 150 | 120 | 100 | **70** | **40** | **20** |
| | 7 | 150 | 130 | 110 | 90 | 60 | 50 | 30 | 0 |

FIG.17A

| | | SENSING STEP | | | | | | | |
|---|---|---|---|---|---|---|---|---|---|
| | | 0 | 1 | 2 | 3 | 4 | 5 | 6 | 7 |
| COMPENSATION STEP | 0 | 240 | 230 | 220 | 210 | 200 | 180 | 170 | 160 |
| | 1 | 230 | 220 | 210 | 200 | 180 | 160 | 150 | 140 |
| | 2 | 220 | 210 | 200 | 180 | 145 | 130 | 125 | 120 |
| | 3 | 210 | 200 | 180 | 160 | 130 | 120 | 100 | 90 |
| | 4 | 200 | **180** | **170** | 140 | 120 | 90 | 80 | 60 |
| | 5 | 180 | 150 | 160 | **130** | **110** | 80 | 60 | 40 |
| | 6 | 160 | 140 | 150 | 120 | 100 | **70** | **40** | 20 |
| | 7 | 150 | 130 | 110 | 90 | 60 | 50 | 30 | 0 |

FIG.17B

| | | SENSING STEP | | | | | | | |
|---|---|---|---|---|---|---|---|---|---|
| | | 0 | 1 | 2 | 3 | 4 | 5 | 6 | 7 |
| COMPENSATION STEP | 0 | 240 | 230 | 220 | 210 | 200 | 180 | 170 | 160 |
| | 1 | 230 | 220 | 210 | 200 | 180 | 160 | 150 | 140 |
| | 2 | 220 | 210 | 200 | 180 | 145 | 130 | 125 | 120 |
| | 3 | 210 | 200 | 180 | 160 | 130 | 120 | 100 | 90 |
| | 4 | **200** | **180** | **170** | **140** | 120 | 90 | 80 | 60 |
| | 5 | 180 | 150 | 160 | 130 | **110** | **80** | 60 | 40 |
| | 6 | 160 | 140 | 150 | 120 | 100 | 70 | **40** | 20 |
| | 7 | 150 | 130 | 110 | 90 | 60 | 50 | 30 | 0 |

FIG.17C

| | | SENSING STEP | | | | | | | |
|---|---|---|---|---|---|---|---|---|---|
| | | 0 | 1 | 2 | 3 | 4 | 5 | 6 | 7 |
| COMPENSATION STEP | 0 | 240 | 230 | 220 | 210 | 200 | 180 | 170 | 160 |
| | 1 | 230 | 220 | 210 | 200 | 180 | 160 | 150 | 140 |
| | 2 | 220 | 210 | 200 | 180 | 145 | 130 | 125 | 120 |
| | 3 | 210 | 200 | 180 | 160 | 130 | 120 | 100 | 90 |
| | 4 | 200 | *180* | *170* | *140* | 120 | 90 | 80 | 60 |
| | 5 | 180 | 150 | 160 | **130** | *110* | *80* | 60 | 40 |
| | 6 | 160 | 140 | 150 | 120 | 100 | **70** | *40* | 20 |
| | 7 | 150 | 130 | 110 | 90 | 60 | 50 | 30 | 0 |

IMAGE FORMATION APPARATUS INCLUDING HOT-ROLL TYPE FIXING DEVICE AND METHOD FOR DETERMINING MALFUNCTION OF TEMPERATURE SENSOR IN THE SAME

This application is based on Japanese Patent Application No. 2007-247244 filed with the Japan Patent Office on Sep. 25, 2007, the entire content of which is hereby incorporated by reference.

BACKGROUND OF THE INVENTION

1. Field of the Invention

The present invention relates to an image formation apparatus including a hot-roll type fixing device and a method for determining malfunction of a temperature sensor in the same, and more particularly to determination as to whether malfunction occurs or not in a non-contact type temperature sensor.

2. Description of the Related Art

In image formation apparatuses such as photocopiers or printers, after a toner image is transferred onto a sheet, heat and pressure are applied to this toner image using a heat roller to fix the image on the sheet. In order to perform such a fixing process more appropriately, temperature management of the heat roller is important. Conventionally, in order to perform such heat roller temperature management, a variety of methods for measuring the surface temperature of the heat roller have been proposed.

Conventionally, since the surface of the heat roller is covered with a hard material, a contact type temperature sensor has been used which comes into contact with the roller surface to detect the surface temperature. In such a contact-type temperature sensor, since the temperature detection is performed directly, detection errors resulting from attachment of dust, toner, paper dust and the like in the apparatus are relatively few.

By contrast, recently, the surface of the heat roller is covered with a soft material and the surface of the heat roller receives a scratch by being contact with the temperature sensor, so that the contact type temperature sensor as described above cannot be used. Therefore, a non-contact type temperature sensor is proposed which can detect the surface temperature without coming into contact with the heat roller.

For example, Japanese Laid-Open Patent Publication No. 2004-151471 discloses an image formation apparatus including a roller heat sensing sensor for sensing heat radiating from a heat roller and an ambient temperature sensing sensor for sensing the ambient temperature of the roller heat sensing sensor.

When such a non-contact type temperature sensor is used, means for preventing detection errors or deterioration of detection accuracy due to attachment of dust, toner, paper dust and the like is required. For example, Japanese Laid-Open Patent Publication No. 2000-259033 discloses an image formation apparatus including non-contact type surface temperature detection means provided in non-contact with a fixing roller surface for detecting a surface temperature of a fixing roller and contact type surface temperature detection means provided to be able to contact with the fixing roller for detecting the surface temperature of the fixing roller. According to this image formation apparatus, a detection state of the non-contact type surface temperature detection means is determined based on a fixing roller surface temperature detection signal based on the detection result of the non-contact type surface temperature detection means and a fixing roller surface temperature detection signal based on the detection result of the contact-type surface temperature detection means. This image formation apparatus disclosed in Japanese Laid-Open Patent Publication No. 2000-259033 requires a mechanism that allows the contact-type surface temperature detection means to come into abutment with or go away from the fixing roller and is disadvantageously increased in size and complicated as a whole.

By contrast, Japanese Laid-Open Patent Publication No. 2000-259035 discloses an image formation apparatus capable of sensing a malfunction in a sensor without using a contact type temperature sensor. This image formation apparatus includes infrared radiation detection means for detecting infrared radiation to convert the amount thereof into an electrical signal, temperature compensation means for performing temperature compensation of the infrared radiation detection means, and malfunction sensing means for sensing a malfunction of the temperature compensation means by observing a signal based on the output of the temperature compensation means with respect to a signal based on the output of the infrared radiation detection means.

Furthermore, Japanese Laid-Open Patent Publication No. 2006-047411 discloses an image formation apparatus provided with a non-contact type temperature sensor for sensing a temperature of a heat roller, wherein a correction temperature for correcting a temperature sensed by the non-contact type temperature sensor is determined by comparing a sensed temperature increase time required for a temperature sensed by the non-contact type temperature sensor to attain from a first set temperature to a second set temperature with a reference temperature increase time, which serves as a reference, required for the surface temperature of the heat roller to attain from the first set temperature to the second set temperature.

However, in the image formation apparatus disclosed in Japanese Laid-Open Patent Publication No. 2000-259035, a change of the signal based on the output of the temperature compensation means with respect to a change of the signal based on the output of the infrared radiation detection means per a prescribed time is observed in order to sense malfunction of the temperature compensation means. Therefore, if dust, toner, paper dust or the like attaches to the temperature compensation means (e.g. thermistor) causing the entire offset in the output thereof, malfunctions cannot be detected.

Furthermore, in the image formation apparatus disclosed in Japanese Laid-Open Patent Publication No. 2006-047411, since the correction temperature is determined based on the time required for the temperature sensed by the non-contact type temperature sensor to yield a prescribed temperature increase, proper correction cannot be performed if the entire offset is caused in the output of the non-contact type sensor, as described above. Moreover, correction is performed based on a temperature change between two points of the sensed temperature, so that such correction that reflects the behavior of the sensed temperature during the course cannot be performed.

SUMMARY OF THE INVENTION

The present invention is therefore made to solve the aforementioned problems, and an object of the present invention is to provide an image formation apparatus capable of more accurately determining whether malfunction occurs or not in a temperature sensor detecting a surface temperature of a heat roller in a non-contact manner.

An image formation apparatus in accordance with an aspect of the present invention includes a rotatable heat roller, a first temperature sensor, a second temperature sensor, a temperature estimation portion, a temperature increase portion, and a determination portion. The first temperature sensor detects a temperature at a position at a prescribed distance from a surface of the heat roller. The second temperature sensor detects an ambient temperature of the first temperature sensor. The temperature estimation portion estimates a surface temperature of the heat roller, in accordance with a predetermined relation, based on first and second input values obtained from detected temperatures by the first and second temperature sensors. The temperature increase portion increases the temperature of the heat roller according to the estimated surface temperature of the heat roller. The determination portion determines whether a malfunction occurs or not in the first or second temperature sensor, based on a temporal behavior of multidimensional data including the first input value and the second input value during a temperature increase of the heat roller by the temperature increase portion.

Preferably, the determination portion determines whether a malfunction occurs or not in the first or second temperature sensor, based on a deviation amount of the temporal behavior of the multidimensional data from a predetermined reference temporal behavior.

Further preferably, each of the first and second input values takes on one of a plurality of step values, and the image formation apparatus further includes a storage portion storing a temperature table in which the surface temperature is defined in association with a combination of the first input value and the second input value. The temperature estimation portion obtains the surface temperature corresponding to the first and second input values by referring to the temperature table.

Further preferably, the storage portion further stores a transition destination table in which a weight for a transition from each element to an adjacent element is defined in association with each element of the temperature table. The determination portion refers to the corresponding transition destination table to successively integrate the weight every time an element corresponding to a combination of the first input value and the second input value makes a transition to an adjacent element, and determines whether a malfunction occurs or not in the first or second temperature sensor, based on the integrated weight.

Further preferably, in each transition destination table, a weight for a transition corresponding to the reference temporal behavior is different from a weight for any other transition.

Further preferably, the image formation apparatus further includes a correction portion correcting the surface temperature stored in the temperature table, based on a characteristic feature of deviation of the temporal behavior of the multidimensional data from the reference temporal behavior, when the determination portion determines that the first or second temperature sensor has a malfunction.

Further preferably, the correction portion specifies which of the first and second temperature sensors has a malfunction, based on the characteristic feature of deviation of the temporal behavior of the multidimensional data from the reference temporal behavior.

Preferably, the image formation apparatus further includes a first update portion updating a weight of the transition destination table, based on the temporal behavior of the multidimensional data including the first and second input values during a temperature increase of the heat roller by the temperature increase portion.

Preferably, the storage portion further stores a transition time table in which a standard time required for a transition from each element to an adjacent element is defined, in association with each element of the temperature table. The determination portion refers to the transition time table to successively integrate a time difference between a time taken for a transition of an element corresponding to the first and second input values and the standard time corresponding to the transition and determines a malfunction in the first or second temperature sensor, based on the integrated time difference.

Further preferably, the image formation apparatus further includes a second update portion updating the standard time of the transition time table, based on the temporal behavior of the multidimensional data including the first and second input values during a temperature increase of the heat roller by the temperature increase portion.

Preferably, the first input value is a temperature difference between a detected temperature by the first temperature sensor and a detected temperature by the second temperature sensor. The second input value is a detected temperature by the second temperature sensor.

Preferably, the first input value is a detected temperature by the first temperature sensor. The second input value is a detected temperature by the second temperature sensor.

Preferably, the temperature increase portion starts a temperature increase of the heat roller after the start of rotation of the heat roller.

In accordance with another aspect of the present invention, a method for determining malfunction of a temperature sensor in an image formation apparatus is provided. The image formation apparatus includes a rotatable heat roller, a first temperature sensor detecting a temperature at a position at a prescribed distance from a surface of the heat roller, and a second temperature sensor detecting an ambient temperature of the first temperature sensor. The method includes the steps of: obtaining first and second input values obtained from detected temperatures by the first and second temperature sensors; estimating a surface temperature of the heat roller, in accordance with a predetermined relation, based on the first and second input values; increasing the temperature of the heat roller according to the estimated surface temperature of the heat roller; obtaining the first and second input values during a temperature increase of the heat roller; and determining whether a malfunction occurs or not in the first or second temperature sensor, based on a temporal behavior of multidimensional data including the first input value and the second input value.

Preferably, the step of determining includes the step of determining whether a malfunction occurs or not in the first or second temperature sensor, based on a deviation amount of the temporal behavior of the multidimensional data from a predetermined reference temporal behavior.

Further preferably, each of the first and second input values takes on one of a plurality of step values. The image formation apparatus further includes a storage portion storing a temperature table in which the surface temperature is defined in association with a combination of the first input value and the second input value. The step of estimating includes the step of obtaining the surface temperature corresponding to the first and second input values by referring to the temperature table.

Further preferably, a transition destination table is further stored in which a weight for a transition from each element to an adjacent element is defined in association with each element of the temperature table. The step of determining further includes the steps of: referring to the corresponding transition destination table to successively integrate the weight every time an element corresponding to a combination of the first input value and the second input value makes a transition to an adjacent element; and determining whether a malfunction occurs or not in the first or second temperature sensor, based on the integrated weight.

Further preferably, in each transition destination table, a weight for a transition corresponding to the reference temporal behavior is different from a weight for any other transition.

Further preferably, the malfunction determination method further includes the step of correcting the surface temperature stored in the temperature table, based on a characteristic feature of deviation of the temporal behavior of the multidimensional data from the reference temporal behavior, when it is determined that the first or second temperature sensor has a malfunction, in the step of determining whether a malfunction occurs or not.

Further preferably, the step of correcting includes the step of specifying which of the first and second temperature sensors has a malfunction, based on the characteristic feature of deviation of the temporal behavior of the multidimensional data from the reference temporal behavior.

Preferably, the method further includes the step of updating a weight of the transition destination table, based on the temporal behavior of the multidimensional data including the first and second input values during a temperature increase of the heat roller by the temperature increase portion.

Preferably, the storage portion further stores a transition time table in which a standard time required for a transition from each element to an adjacent element is defined, in association with each element of the temperature table. The step of determining includes the step of referring to the transition time table to successively integrate a time difference between a time taken for a transition of an element corresponding to the first and second input values and the standard time corresponding to the transition, and determining a malfunction in the first or second temperature sensor, based on the integrated time difference.

Further preferably, the method further includes the step of updating the standard time of the transition time table, based on the temporal behavior of the multidimensional data including the first and second input values during a temperature increase of the heat roller by the temperature increase portion.

Preferably, the first input value is a temperature difference between a detected temperature by the first temperature sensor and a detected temperature by the second temperature sensor. The second input value is a detected temperature by the second temperature sensor.

Preferably, the first input value is a detected temperature by the first temperature sensor. The second input value is a detected temperature by the second temperature sensor.

Preferably, the step of increasing the temperature includes the step of starting the temperature increase after the start of rotation of said heat roller.

According to the present invention, whether a malfunction occurs or not in a temperature sensor detecting a surface temperature of a heat roller in a no-contact manner can be determined more accurately.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 3 is a diagram showing an exemplary configuration of a temperature table in accordance with the first embodiment of the present invention.

FIGS. 4A-4C are diagrams illustrating a transition of two-dimensional data over time on the temperature table in a case where detection sensitivity of a roller temperature sensor is reduced.

FIG. 16 is a diagram showing an exemplary configuration of a temperature table in accordance with the second embodiment of the present invention.

FIGS. 17A-17C are diagrams illustrating a transition of two-dimensional data over time on the temperature table in a case where the detection sensitivity of the roller temperature sensor is reduced.

DESCRIPTION OF THE PREFERRED EMBODIMENTS

Figure 1:
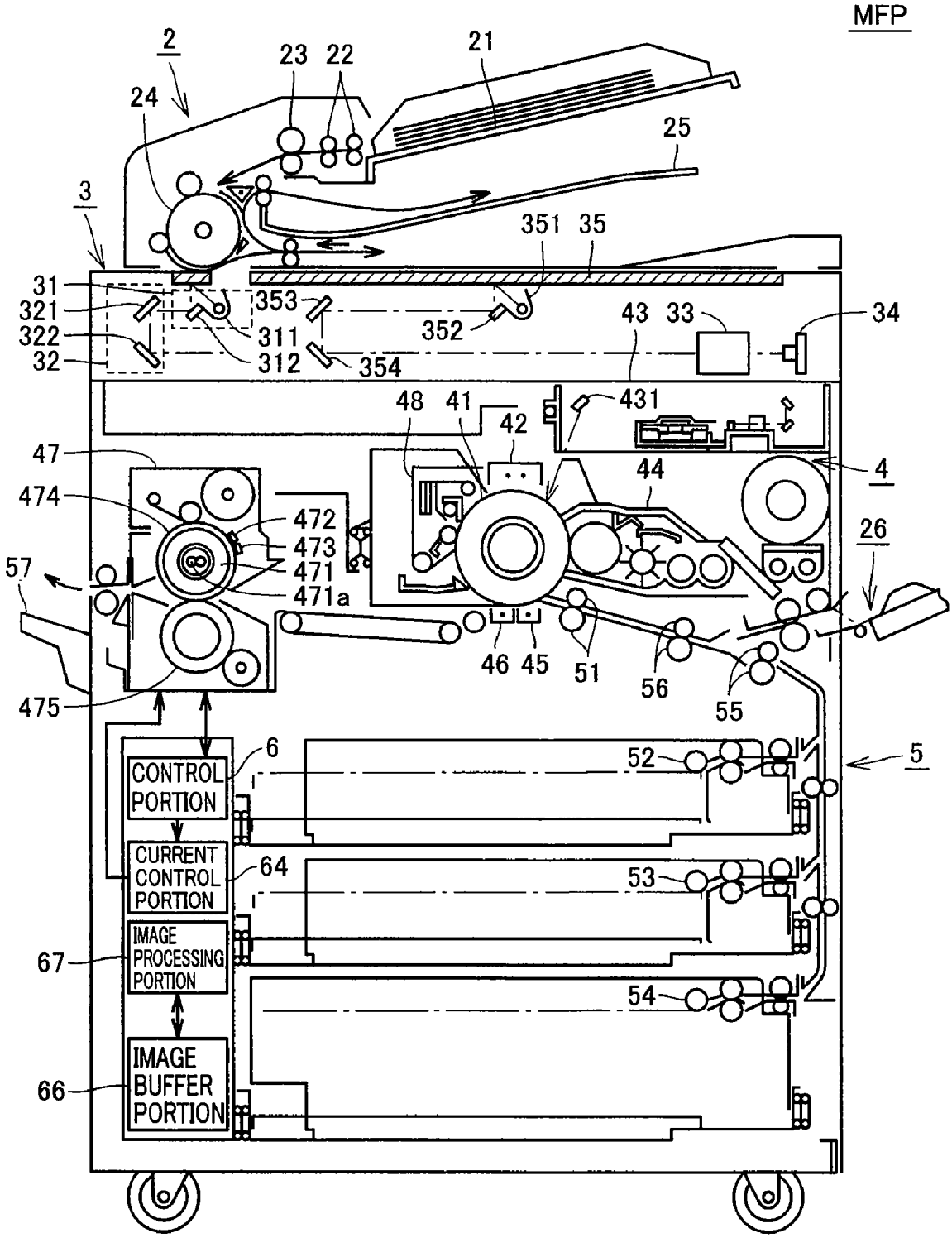
FIG. 1 is a schematic structural view of an image formation apparatus in accordance with a first embodiment of the present invention.

The embodiments of the present invention will be described in detail with reference to the figures. It is noted that the same or corresponding parts in the figures will be denoted with the same reference characters and the description thereof will not be repeated.

[First Embodiment]

(Configuration of Image Formation Apparatus)

The present invention is applied to an image formation apparatus including a hot-roll type fixing device and is applicable to any image formation apparatus as long as it includes a heat roller that can be increased in temperature. In the following description, as a typical example of the image formation apparatus in accordance with the present invention, MFP (Multi Function Peripheral) equipped with a plurality of functions such as a copy function, a print function, a facsimile function and a scanner function is shown. However, the present invention is also applicable to a photocopier only including a copy function or a printer only including a print function.

Referring to FIG. 1, an image formation apparatus MFP in accordance with a first embodiment of the present invention includes an automatic document feeder portion 2, an image scanning portion 3, an image formation portion 4, and a paper-feeding portion 5.

Automatic document feeder portion 2 is a part for performing continuous document scanning and comprised of a document feeding stage 21, a delivery roller 22, a resist roller 23, a transport drum 24, and a paper-discharging stage 25. A document to be scanned is placed on document feeding stage 21 and delivered sheet by sheet by the operation of delivery roller 22. Then, the delivered document is once stopped and aligned at the end by resist roller 23 and thereafter transported to transport drum 24. Then, this document is rotated integrally with the drum surface of transport drum 24 and has its image plane scanned by image scanning portion 3 during the course of the process. Thereafter, the document branches off from the drum surface at a position approximately halfway around the drum surface of transport drum 24 to be discharged to paper-discharging stage 25.

Image scanning portion 3 is comprised of a first mirror unit 31, a second mirror unit 32, an imaging lens 33, an image pickup device 34, and a platen glass 35. First mirror unit 31 includes a light source 311 and a mirror 312 and applies light beams from light source 311 to the passing document at a position immediately below transport drum 24. Of the light beams applied from light source 311, the light beam reflected by the document impinges on second mirror unit 32 through mirror 312. Second mirror unit 32 includes mirrors 321 and 322 arranged orthogonal to the document moving direction, and the reflected light beam from first mirror unit 31 is successively reflected at mirrors 321 and 322 and introduced to imaging lens 33. Imaging lens 33 images the reflected light beam on the linear image pickup device 34.

In image formation apparatus MFP in accordance with the present embodiment, a document may be placed on platen glass 35 so that image information is scanned. In this case, a movable light source 351 and a mirror 352 scan the image plane of a document. With this scanning, light applied from light source 351 is successively reflected at mirrors 353 and 354 arranged orthogonal to the document moving direction and is then introduced to imaging lens 33. Imaging lens 33 images this reflected light on the linear image pickup device 34.

Furthermore, image pickup device 34 converts the received reflected light into an electrical signal to be output to an image processing portion 67 described later. Image information of the document scanned in image scanning portion 3, that is, the electrical signal output from image pickup device 34 undergoes image processing in image processing portion 67 to be image data and thereafter stored in an image buffer portion 66.

Image formation portion 4 is comprised of a photoconductive drum 41, a charger 42, an image writing portion 43, a development portion 44, a transfer unit 45, a static eliminator 46, a fixing device 47, and a cleaning portion 48. When an instruction to start image formation is given by a user operation or the like, image writing portion 43 reads image data stored in image buffer portion 66. Then, image writing portion 43 rotatably actuates a polygon mirror (not shown) according to the read image data to apply a laser beam emitted from a laser emitter 431 as a main scanning exposure in the axial direction of photoconductive drum 41. Simultaneously, sub-scanning by the rotation of photoconductive drum 41 itself is also performed. Before this laser beam radiation, a prescribed potential is applied to photoconductive drum 41 by charger 42 so that an electrostatic latent image of the document image is formed on a photoconductive layer of photoconductive drum 41 by the main scanning exposure and the sub-scanning.

Development portion 44 inversely develops the electrostatic latent image formed on photoconductive drum 41 to generate a toner image. In parallel with this operation in development portion 44, a manual paper-feeding portion 26 and any one of delivery rollers 52, 53, 54 corresponding to each paper-feeding cassette of paper-feeding portion 5 accommodating sheets is actuated to supply a sheet. This supplied sheet is transported by transport rollers 55, 56 and a timing roller 51 and fed to photoconductive drum 41 in synchronization with the toner image formed on photoconductive drum 41.

Transfer unit 45 transfers the toner image formed on photoconductive drum 41 onto a sheet by applying voltage of the opposite polarity to photoconductive drum 41. Then, static eliminator 46 detaches the sheet from photoconductive drum 41 by removing static electricity from the sheet having the toner image transferred thereon. Thereafter, the sheet having the toner image transferred thereon is transported to fixing device 47.

Fixing device 47 includes a heat roller 474 and a pressure roller 475, and the temperature of heat roller 474 is controlled by a control portion 6 as described later. Heat roller 474 heats the sheet to fuse the toner transferred thereon, and, in addition, the compression force between heat roller 474 and pressure roller 475 allows the fused toner to be fixed on the sheet. Then, the sheet is discharged to a tray 57.

On the other hand, after photoconductive drum 41 from which the sheet has been detached has its rest potential removed, the residual toner is removed and cleaned by cleaning portion 48. Then, the next image formation process is executed.

Fixing device 47 includes rotatable heat roller 474 having a heat-resistant parting layer formed on a surface of a base body 471 made of metal such as aluminum and pressure roller 475 arranged parallel to the rotation shaft of heat roller 474. A heating element 471*a* for increasing the temperature of heat roller 474 is inserted in base body 471. Heating element 471*a* is typically formed of a halogen lamp heater. Heat roller 474 has a heat-resistant parting layer made of fluoroplastics or the like on the surface thereof and has it temperature increased by heat generated in heating element 471*a*. It is noted that the heat generation amount of heating element 471*a* is controlled by current supplied from a current control portion 64.

Pressure roller 475 is arranged in contact with heat roller 474 and is formed of a base body made of metal such as aluminum and a heat-resistant elastic layer made of silicone rubber formed on the surface of the base body.

In particular, fixing device 47 in accordance with the present embodiment is provided with a roller temperature sensor 472 detecting heat (infrared radiation) radiating from heat roller 474 and an ambient temperature sensor 473 detecting the ambient temperature of roller temperature sensor 472 at a position at a prescribed distance d from heat roller 474. Here, prescribed distance d is set at 0.2-8 mm, more preferably at 4.5-5.5 mm. Furthermore, roller temperature sensor 472 and ambient temperature sensor 473 are typically formed of thermistors or thermocouples.

Control portion 6 estimates a surface temperature of heat roller 474, in accordance with a predetermined relation, based on two input values obtained from respective temperature signals detected by roller temperature sensor 472 and ambient temperature sensor 473. Then, control portion 6 controls a temperature increase of heat roller 474 according to the estimated surface temperature of heat roller 474.

In addition, control portion 6 determines whether a malfunction occurs or not in roller temperature sensor 472 and/or ambient temperature sensor 473, based on the temporal behavior of multidimensional data including two input values obtained from respective temperature signals detected in roller temperature sensor 472 and ambient temperature sensor 473 during a temperature increasing operation of heat roller 474 after power-on (also referred to as "warm-up operation" hereinafter).

Figure 2:
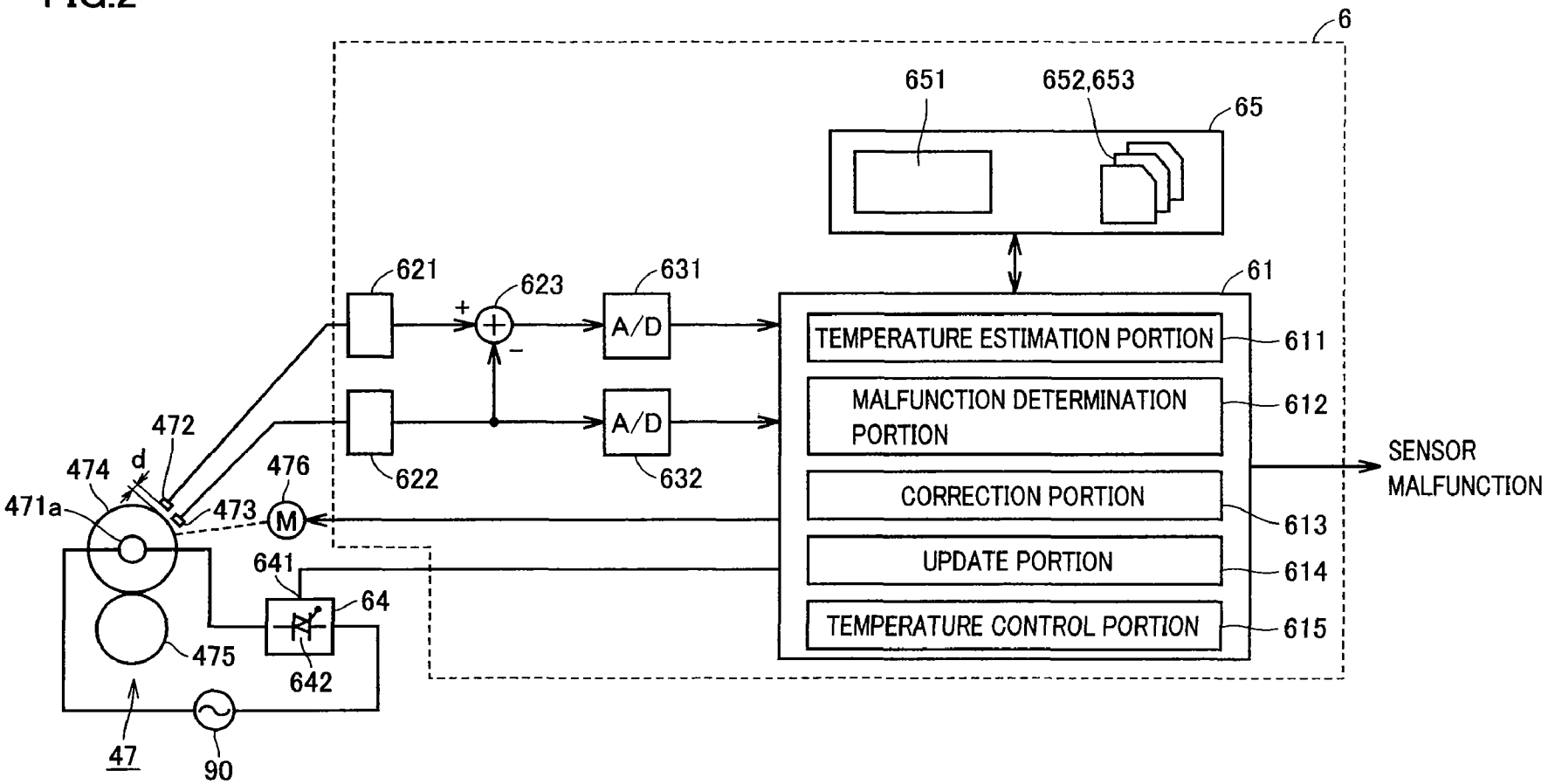
FIG. 2 is a diagram showing a control structure concerning a heat roller in the image formation apparatus in accordance with the first embodiment of the present invention.

Referring to FIG. 2, the temperature increase control of heat roller 474 is typically realized by controlling a current amount supplied from an external power supply 90 to heating element 471*a*. Current control portion 64 is arranged between heating element 471*a* and external power supply 90 and controls current supplied to heating element 471*a* according to a control command from control portion 6. Current control portion 64 is typically formed of a switching element 642 such as TRIAC and changes the AC current conduction ratio (on duty) according to a control command (gate input 641) from control portion 6.

Fixing device 47 further includes a fixing motor 476 for rotatably driving heat roller 474, and the rotation of fixing motor 476 is controlled by a rotation command from control portion 6.

Control portion 6 estimates the surface temperature of heat roller 474 based on two input values obtained from the respective temperature signals detected by roller temperature sensor 472 and ambient temperature sensor 473. In the present embodiment, a differential type temperature estimation method is representatively illustrated.

More specifically, control portion 6 includes buffer portions 621, 622, a subtraction portion 623, A/D (Analog to Digital) converters 631, 632, a processing device 61, and a storage portion 65.

Buffer portion 621 accumulates sense signals according to the sensed temperature output from roller temperature sensor 472 for a prescribed period and then outputs the accumulated value to subtraction portion 623. In addition, buffer portion 622 accumulates sense signals according to the sensed temperature output from ambient temperature sensor 473 for a prescribed period and then outputs the accumulated value to subtraction portion 623 and A/D converter 632. In other words, buffer portions 621 and 622 produce and then output the moving average of the sensed signals respectively output from roller temperature sensor 472 and ambient temperature sensor 473. Accordingly, the effect of noise included in the sense signal from each temperature sensor 472 and 473 can be reduced.

Subtraction portion 623 calculates a difference signal between the sense signal of roller temperature sensor 472 output from buffer portion 621 and the sense signal of ambient temperature sensor 473 output from buffer portion 622 and outputs the difference signal to A/D converter 631.

A/D converter 631 samples and quantizes the difference signal (analog signal) output from subtraction portion 623 at prescribed intervals to generate a first input signal (digital signal). On the other hand, A/D converter 632 samples and quantizes the sense signal (analog signal) of ambient temperature sensor 473 output from buffer portion 621 at prescribed intervals to generate a second input signal (digital signal). Therefore, each of the first input signal and the second input signal takes on one of a plurality of step values (for example, 256 steps) according to the quantization bit rate of A/D converter 631 or 632.

Processing device 61 is configured to typically include a CPU (Central Processing Unit) and implements the functions of a temperature estimation portion 611, a malfunction determination portion 612, a correction portion 613, an update portion 614 and a temperature control portion 615 by reading and executing a program stored beforehand in a non-volatile storage portion (not shown) such as ROM.

Temperature estimation portion 611 estimates the surface temperature of heat roller 474, in accordance with a predetermined relation, based on the first input signal and the second input signal obtained from the sensed temperatures by roller temperature sensor 472 and ambient temperature sensor 473. More specifically, temperature estimation portion 611 refers to a temperature table 651 stored beforehand in storage portion 65 to obtain a surface temperature corresponding to a combination of the value of the first input signal and the value of the second input signal.

Storage portion 65 is a rewritable non-volatile storage device and stores temperature table 651 as well as a transition destination table 652 and a transition time table 653 described later.

Referring to FIG. 3, in temperature table 651, a surface temperature of heat roller 474 is defined beforehand in association with a combination of a differential step as the first input signal and a compensation step as the second input signal. Although FIG. 3 shows a case where a 8-step (three bits) signal is output from A/D converters 631 and 632 (FIG. 2) for the sake of brevity, a signal of more steps may be output from A/D converters 631 and 632. In general, as the number of steps (resolution) is increased, estimation accuracy of the surface temperature of heat roller 474 is improved. For example, assuming that the detection range of the temperature sensor is 0-200° C. and the corresponding temperature signal is a linear output, the temperature width per step is 25° C. if the output of the A/D converter is eight-step, and the temperature width per step is 3.125° C. if the output of the A/D converter is 64-step. Here, in A/D converters 631 and 632, quantization may be performed with a fixed amplitude value or a quantization width may be varied according to the absolute value of the amplitude.

As shown in FIG. 3, in temperature table 651, a surface temperature of heat roller 474 can be represented as a position of two-dimensional data including a differential step (the value of the first input signal) and a compensation step (the value of the second input signal). It is noted that the surface temperature of heat roller 474 in each element of temperature table 651 is empirically obtained beforehand.

Each element of this temperature table 651 is determined in reflection of the detected temperature of heat (infrared radiation) radiating from heat roller 474 and the ambient temperature of the temperature sensor itself, so that the surface temperature of heat roller 474 which is greatly affected by the ambient environment can be estimated appropriately.

In the following, two-dimensional data in temperature table 651 is represented as "Temp [value of compensation step][value of differential step]." For example, two dimensional data with compensation step="6" and differential step="0" is represented as Temp [6][0].

Although FIG. 3 shows a case where the surface temperature of heat roller 474 is defined in association with two-dimensional data of a differential step (the value of the first input signal) and a compensation step (the value of the second input signal), the surface temperature of heat roller 474 may be estimated in association with multidimensional data of dimensions greater than two dimensions, with addition of another parameter (for example, the environmental temperature of image formation apparatus MFP).

When the temperature of heat roller 474 starts to be increased by the warm-up operation, two-dimensional data (two-dimensional position) corresponding to the surface temperature in temperature table 651 successively makes a transition from an element on the low-temperature side toward an element on the high-temperature side.

Referring to FIG. 2 again, temperature control portion 615 controls the temperature increase for heat roller 474 according to the surface temperature of heat roller 474 estimated by temperature estimation portion 611 as described above, during the warm-up operation executed when image formation apparatus MFP is powered on or when a return command from the stand-by mode is given. In other words, temperature control portion 615 gives a prescribed control command to current control portion 64 according to the estimated surface temperature of heat roller 474. It is noted that temperature control portion 615, current control portion 64 and heating element 471*a* correspond to "temperature increase portion."

Referring to FIG. 3 again, consider the case, as an example, where two-dimensional data before warm-up start is Temp [6][0] (the surface temperature of heat roller 474 is 20° C.) and the target temperature of warm-up is 180° C. In this case, by the warm-up operation, the two-dimensional data makes a transition over time in the order of Temp [6][0]→Temp [6][1]→Temp [6][2]→Temp [5][3]→Temp [5][4]→Temp [4][5]→Temp [4][6].

Here, dust, toner, paper dust or the like from a sheet frequently attaches to roller temperature sensor 472 and ambient temperature sensor 473 arranged in proximity to heat roller 474. Furthermore, radiation heat from heat roller 474 may thermally degrade roller temperature sensor 472 and ambient temperature sensor 473. Therefore, the temperature signals from roller temperature sensor 472 and ambient temperature sensor 473 may deviate from the values indicating the original temperature.

Then, in the following, the operation in the case where the detection sensitivity of roller temperature sensor 472 is lowered because of attachment of dust, toner, paper dust or the like to roller temperature sensor 472 will be described. In other words, it is assumed that the temperature signal output from roller temperature sensor 472 is lowered by a prescribed level from the original level.

FIGS. 4A-4C are diagrams illustrating a transition of two-dimensional data over time on temperature table 651 in the case where the detection sensitivity of roller temperature sensor 472 is lowered. It is noted that FIGS. 4A-4C show the case where the temperature signal from roller temperature sensor 472 is uniformly lowered and the value of differential step is lowered by a 1 AD value from the original value.

FIG. 4A is a diagram illustrating a target trajectory of the temperature control operation in temperature control portion 615. As shown in FIG. 4A, temperature control portion 615 performs temperature control such that two-dimensional data on temperature table 651 makes a transition along the similar trajectory as the two-dimensional data shown in FIG. 3.

However, in actuality, this input value of differential step is equivalent to the value obtained by subtracting 1 AD value from the original value, so that the trajectory created in the two-dimensional data on temperature table 651 is as shown in FIG. 4B, for example. In other words, in the state in which the detection sensitivity of roller temperature sensor 472 is lowered, the two-dimensional data makes a transition over time in the order of Temp [6][1]→Temp [5][2]→Temp [5][3]→Temp [4][4]→Temp [4][5]→Temp [4][6]→Temp [4][7].

As a result, the surface temperature of heat roller 474 exceeds 180° C., which is the original target temperature, and reaches as high as 200° C.

Then, the trajectory shown in FIG. 4A and the trajectory shown in FIG. 4B are overlapped as shown in FIG. 4C. Referring to FIG. 4C, there are two different points between the target trajectory shown in FIG. 4A and the actual trajectory shown in FIG. 4B. In other words, the actual trajectory shown in FIG. 4B shifts horizontally on the paper plane with respect to the target trajectory shown in FIG. 4A.

It is noted that when the detection sensitivity of ambient temperature sensor 473 is lowered because of attachment of dust, toner, paper dust or the like to ambient temperature sensor 473, the actual trajectory of two-dimensional data shifts vertically on the paper plane with respect to the target trajectory.

Then, in image formation apparatus MFP in accordance with the present embodiment, whether a malfunction occurs or not in roller temperature sensor 472 and ambient temperature sensor 473 is determined by comparing the trajectory (temporal behavior) actually created by two-dimensional data on temperature table 651 with the target trajectory.

More specifically, referring to FIG. 2, malfunction determination portion 612 successively integrates a prescribed weight for each transition from one element to the adjacent element, which corresponds to the trajectory (temporal behavior) of two-dimensional data on temperature table 651, and determines whether a malfunction occurs or not in roller temperature sensor 472 and ambient temperature sensor 473, based on the integrated weight. This weight is set to reflect the deviation amount from the original target trajectory and is also referred to as "reliability" hereinafter. Then, as the value of the reliability becomes larger, the deviation amount from the target trajectory is small, as an example. Therefore, malfunction determination portion 612 determines that a malfunction occurs in at least one of roller temperature sensor 472 and ambient temperature sensor 473, if the reliability integrated according to the trajectory from the start to the end of warm-up operation is equal to or less than a prescribed value.

The reliability as described above is stored in a plurality of transition destination tables 652 associated with each element of temperature table 651.

Figure 5:
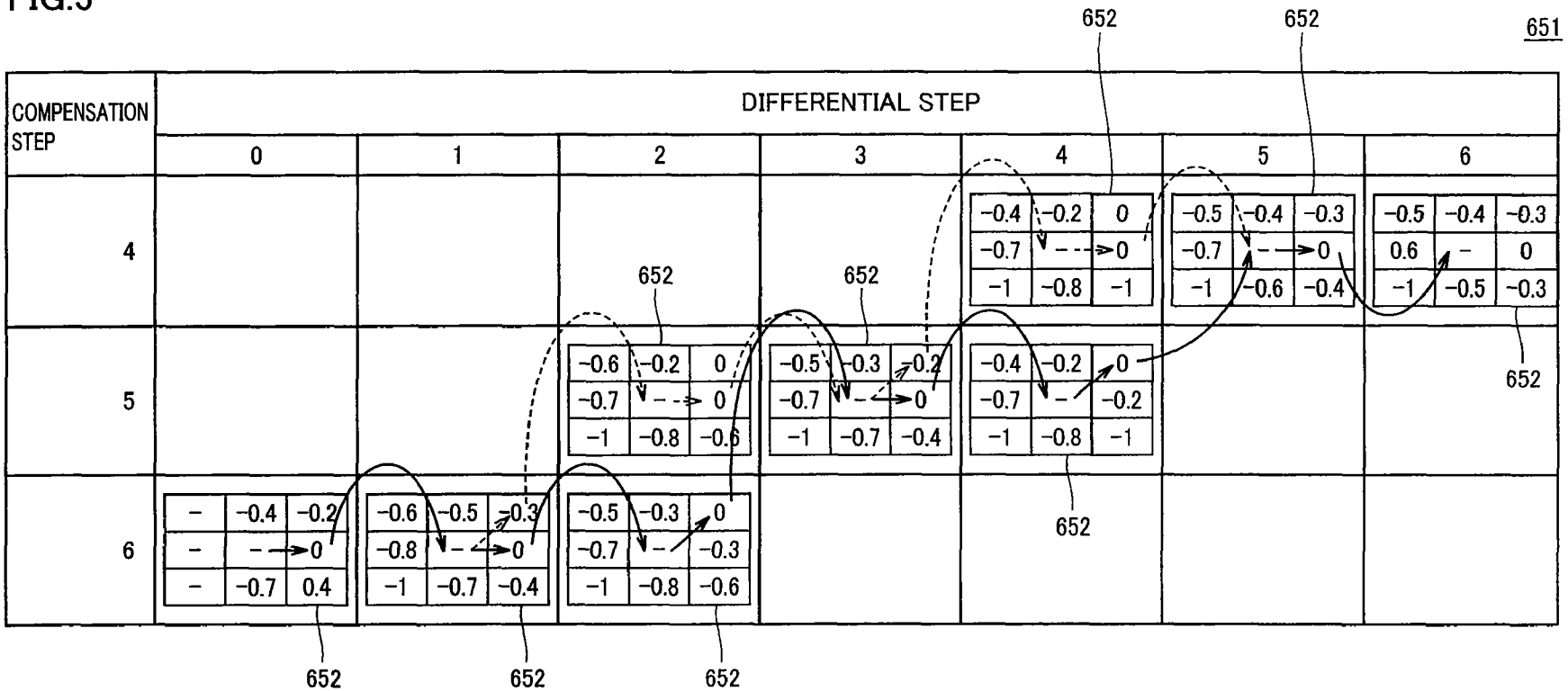
FIG. 5 is a diagram illustrating an integration process of reliability corresponding to a trajectory of two-dimensional data corresponding to FIGS. 4A-4C.

Referring to FIG. 5, first, each of transition destination tables 652 is associated with one element in temperature table 651 and stored beforehand. Then, in each of transition destination tables 652, reliability for the transition from the corresponding element to the adjacent element is each defined. For example, in transition destination table 652 corresponding to Temp [6][0], the reliability for total five transition destinations Temp[5][0], Temp [5][1], Temp [6][1], Temp [7][1], Temp [7][0] adjacent to Temp [6][0] is defined. Then, the largest value "0" in transition table 652 is assigned to the transition from Temp [6][0] to Temp [6][1] corresponding to the target trajectory, and the smaller values different from this "0" are assigned to the other transitions. In other words, a non-zero negative value is assigned to the transition different from the target trajectory.

In this manner, malfunction determination portion 612 successively integrates reliability according to the temporal behavior of the two-dimensional data on temperature table 651 with reference to transition destination table 652.

For example, when the two-dimensional data successively makes a transition along the target trajectory shown in FIG. 4A, the integrated value by the transition is "0." On the other hand, when the two-dimensional data successively makes a transition along the actual trajectory shown in FIG. 4B, the integrated value by the transition is "−0.5." In other words, in the actual trajectory, in the transition from Temp [6][1] to Temp [5][2], "−0.3" is added as reliability, and, in the transition from Temp [5][3] to Temp [4][4], "−0.2" is added as reliability. As a result, the reliability in the actual trajectory is integrated as "−0.5."

In this manner, malfunction determination portion 612 determines whether or not a malfunction occurs or not in roller temperature sensor 472 and ambient temperature sensor 473, based on the magnitude of the integrated reliability. Then, if it is determined that a malfunction occurs in roller temperature sensor 472 or ambient temperature sensor 473, malfunction determination portion 612 determines whether or not the operation of fixing device 47 can be continued. In other words, malfunction determination portion 612 corrects the occurring sensor malfunction and then determines whether or not fixing device 47 can be continuously operated. Then, if it is determined that the operation of fixing device 47 cannot be continued, malfunction determination portion 612 stops the operation of image formation apparatus MFP and also displays on a not-shown panel portion or the like that the continuous operation is not allowed due to occurrence of malfunction. On the other hand, if it is determined that the operation of fixing device 47 can be continued, malfunction determination portion 612 allows correction portion 613 to execute a correction operation for the first input signal or the second input signal.

Correction portion 613 specifies which of roller temperature sensor 472 and ambient temperature sensor 473 has malfunction, based on the characteristic feature of deviation of the actual trajectory from the target trajectory, in response to a correction command from malfunction determination portion 612, and in addition, corrects the contents of temperature table 651 corresponding to the temperature sensor that has the malfunction.

Figures 6, 7:
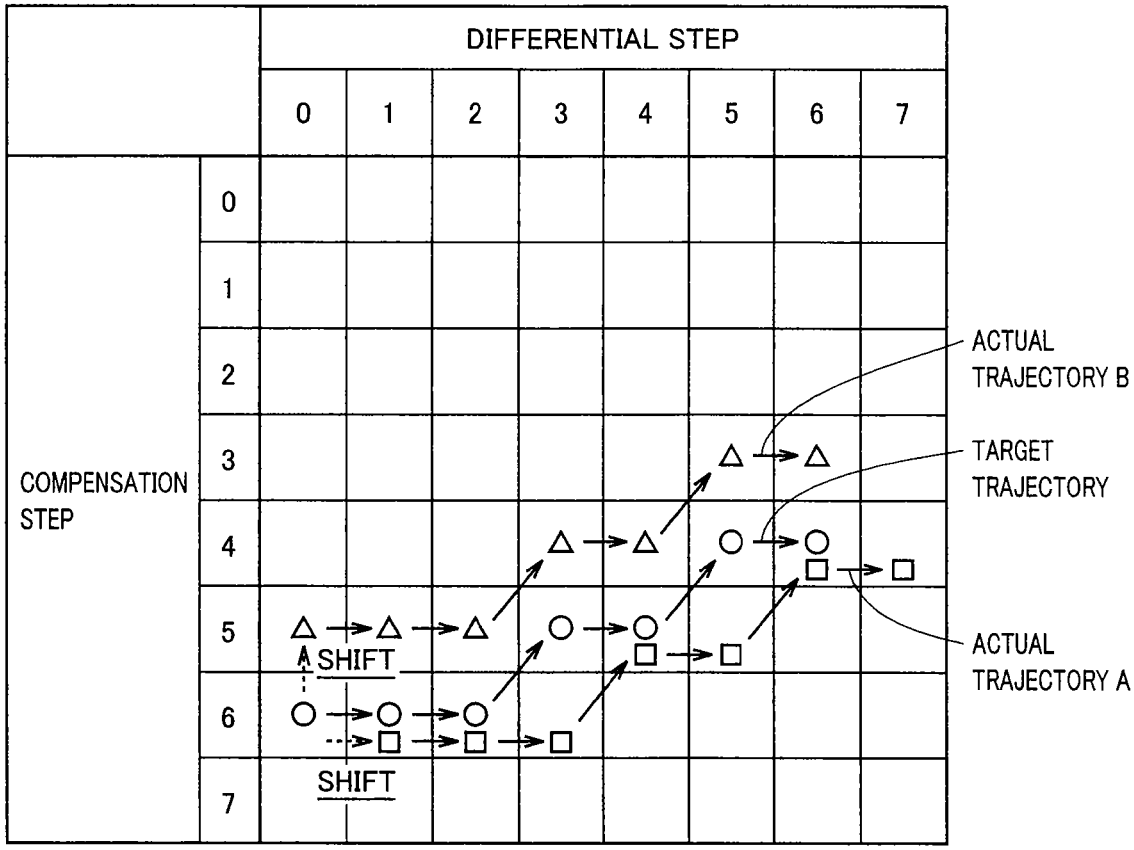
FIG. 6 is a diagram showing an example of an actual trajectory appearing when a malfunction occurs in a temperature sensor.
FIG. 7 is a diagram showing an exemplary data structure of a transition time table.

Referring to FIG. 6, as an example, when a malfunction occurs in roller temperature sensor 472, the differential step (the value of the first input signal) obtained from the sensed temperature output from this roller temperature sensor 472 is affected. As a result, the temporal behavior of the two-dimensional data which appears on temperature table 651 is as shown by the actual trajectory A in FIG. 6. In other words, the actual trajectory A is such a trajectory that is shifted horizontally on the paper plane with respect to the target trajectory.

On the other hand, when a malfunction occurs in ambient temperature sensor 473, the differential step (the value of the first input signal) and the compensation step (the value of the second input signal) obtained from the sensed temperature output from this ambient temperature sensor 473 are affected. In particular, since the effect on the compensation step (the value of the second input signal) is relatively large, the temporal behavior of the two-dimensional data which appears on temperature table 651 is as shown by the actual trajectory B in FIG. 6. In other words, the actual trajectory B is such a trajectory that is shifted vertically on the paper plane with respect to the target trajectory.

Then, correction portion 613 specifies which of roller temperature sensor 472 and ambient temperature sensor 473 has malfunction, based on the characteristic feature of such a deviation of the actual trajectory from the target trajectory. In addition, correction portion 613 shifts the contents of temperature table 651 in the direction to correct the detected deviation and updates the same as new temperature table 651. In other words, correction portion 613 shifts the combination of the differential step and the compensation step corresponding to each surface temperature stored in temperature table 651.

In this manner, correction portion 613 corrects the input value, so that image formation apparatus MFP can be continuously operated without requiring repairing by a user, a maintenance person or the like, if the malfunction occurring in roller temperature sensor 472 and ambient temperature sensor 473 is relatively minor.

In addition to the malfunction determination based on the integrated value of reliability as described above, malfunction determination portion 612 in accordance with the present embodiment determines whether or not a malfunction occurs in the temperature sensor, based on the time required for a transition of two-dimensional data on temperature table 651. More specifically, malfunction determination portion 612 compares the time required for the transition from one element to the adjacent element, which corresponds to the trajectory (temporal behavior) of two-dimensional data in temperature table 651, with a predetermined standard time of the transition, and successively integrates this time difference. Then, malfunction determination portion 612 determines whether or not a malfunction occurs in roller temperature sensor 472 and ambient temperature sensor 473, based on this integrated time difference. In other words, malfunction determination portion 612 monitors the time required for two-dimensional data on temperature table 651 to make a transition thereby to determine its temporal behavior in a time domain.

The aforementioned standard time is stored in a plurality of transition time tables 653 associated with each element of temperature table 651.

FIG. 7 is a diagram showing an exemplary data structure of transition time table 653. Referring to FIG. 7, each of transition time tables 653 is associated with one element of temperature table 651 (FIG. 3) and stored in storage portion 65 beforehand. In transition time table 653, the standard time required for the transition from the associated element to the adjacent element is each defined. It is noted that each standard time is empirically obtained beforehand.

FIG. 7 shows the data structure of transition time table 653 corresponding to Temp [6][0] of temperature table 651. In this transition time table 653, the standard time required for total five transition destinations, Temp [5][0], Temp [5][1], Temp [6][1], Temp [7][1], Temp [7][0] adjacent to Temp [6][0] is defined.

In this manner, malfunction determination portion 612 successively integrates the time difference from the display time, according to the temporal behavior of two-dimensional data on temperature table 651, with reference to transition time table 653. For example, in temperature table 651, if the time required for the two-dimensional data to make a transition from TEMP [6][0] to TEMP [6]1 [1] is 0.6[s], malfunction determination portion 612 integrates 0.4[s] as a time difference from the corresponding standard time 1 [s] defined in transition time table 653. Then, if the time difference integrated according to the trajectory from the start to the end of the warm-up operation is a prescribed time or more, malfunction determination portion 612 determines that at least one of roller temperature sensor 472 and ambient temperature sensor 473 has malfunction.

The other points are similar to the malfunction determination method based on the integrated value of reliability and therefore the detailed description will not be repeated.

In addition to the malfunction determination logic as described above, when the values of the differential step and the compensation step greatly vary in a short time, it may also be determined that at least one of roller temperature sensor 472 and ambient temperature sensor 473 has malfunction.

In the foregoing description, the configuration using transition destination table 652 and transition time table 653 with the predetermined values has been described. However, the values defined in these tables may be dynamically updated.

Referring to FIG. 2 again, update portion 614 updates the reliability stored in transition destination table 652 and the standard time stored in transition time table 653, based on the temporal behavior of the differential step (the value of the first input signal) and the compensation step (the value of the second input signal) during the warm-up operation.

Specifically, update portion 614 calculates the most appropriate value in each condition, for example, by averaging the actual values of the differential steps (the values of the first input signal) and the compensation steps (the values of the second input signal) obtained in warm-up operations at different times, and updates the contents of the transition destination table 652 and transition time table 653 with the calculated value. Such a process of updating transition destination table 652 and transition time table 653 reduces the effect of aging of each part with the operation of image formation apparatus MFP.

(Process Flow)

Figure 8:
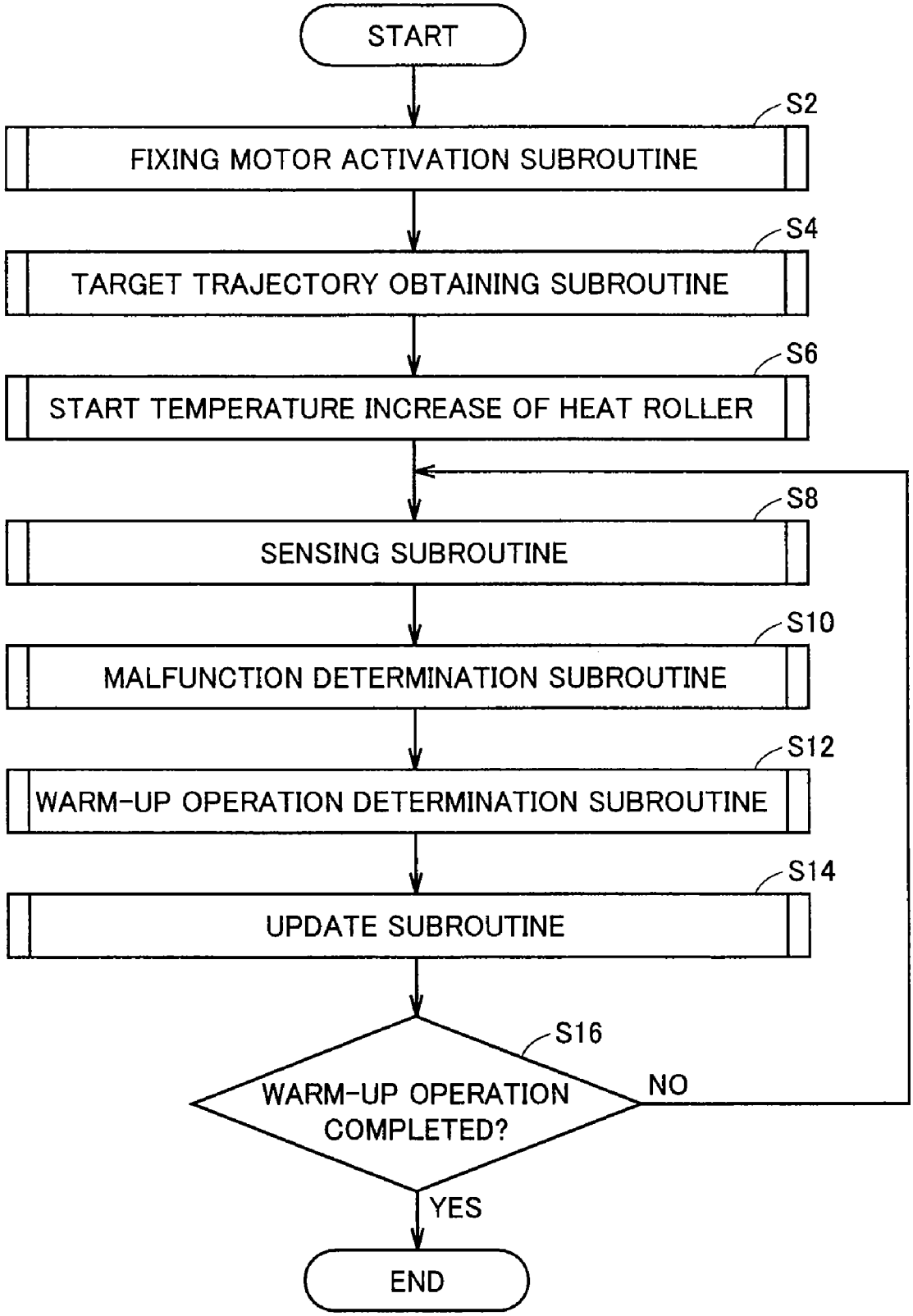
FIG. 8 is a flowchart showing a process procedure of a warm-up operation in the image formation apparatus in accordance with the first embodiment of the present invention.

FIG. 8 is a flowchart showing a process procedure of the warm-up operation in image formation apparatus MFP in accordance with the first embodiment of the present invention. This flowchart is typically implemented by the function of each portion shown in FIG. 2 when processing device 61 reads and executes a program stored beforehand.

Referring to FIG. 8, when a user operates a not-shown power switch, the warm-up operation is started. In this warm-up operation, processing device 61 first executes a subroutine to activate fixing motor 476 (step S2). Then, processing device 61 executes a target trajectory obtaining subroutine concerning the warm-up operation (step S4). Then, processing device 61 starts a temperature increase of heat roller 474 (step S6). More specifically, processing device 61 gives a control command to current control portion 64 to start heat generation from heating element 471*a*. Here, a temperature increase of heat roller 474 is started after the start of rotation of heat roller 474 in order to prevent reduction of the surface temperature of heat roller 474 due to the rotational acceleration immediately after the start-up of heat roller 474.

Thereafter, processing device 61 executes a subroutine to sense an input change of the first input signal and the second input signal (step S8). More specifically, processing device 61 senses a temporal change caused in the differential step and the compensation step. Then, processing device 61 executes a subroutine to determine whether or not a malfunction occurs in roller temperature sensor 472 and ambient temperature sensor 473, base on the execution result of the input change sensing subroutine (step S10).

Subsequently, processing device 61 executes a warm-up operation determination subroutine for determining a state of the warm-up operation (step S12). Then, processing device 61 execute an update subroutine for updating the values stored in transition destination table 652 and transition time table 653 (step S14).

Then, processing device 61 determines whether or not the warm-up operation is completed (step S16), and if the warm-up operation is not completed (NO in step S16), the process after step S8 is executed again.

On the other hand, if the warm-up operation is completed (YES in step S116), the process concerning the warm-up operation is ended.

Figure 9:
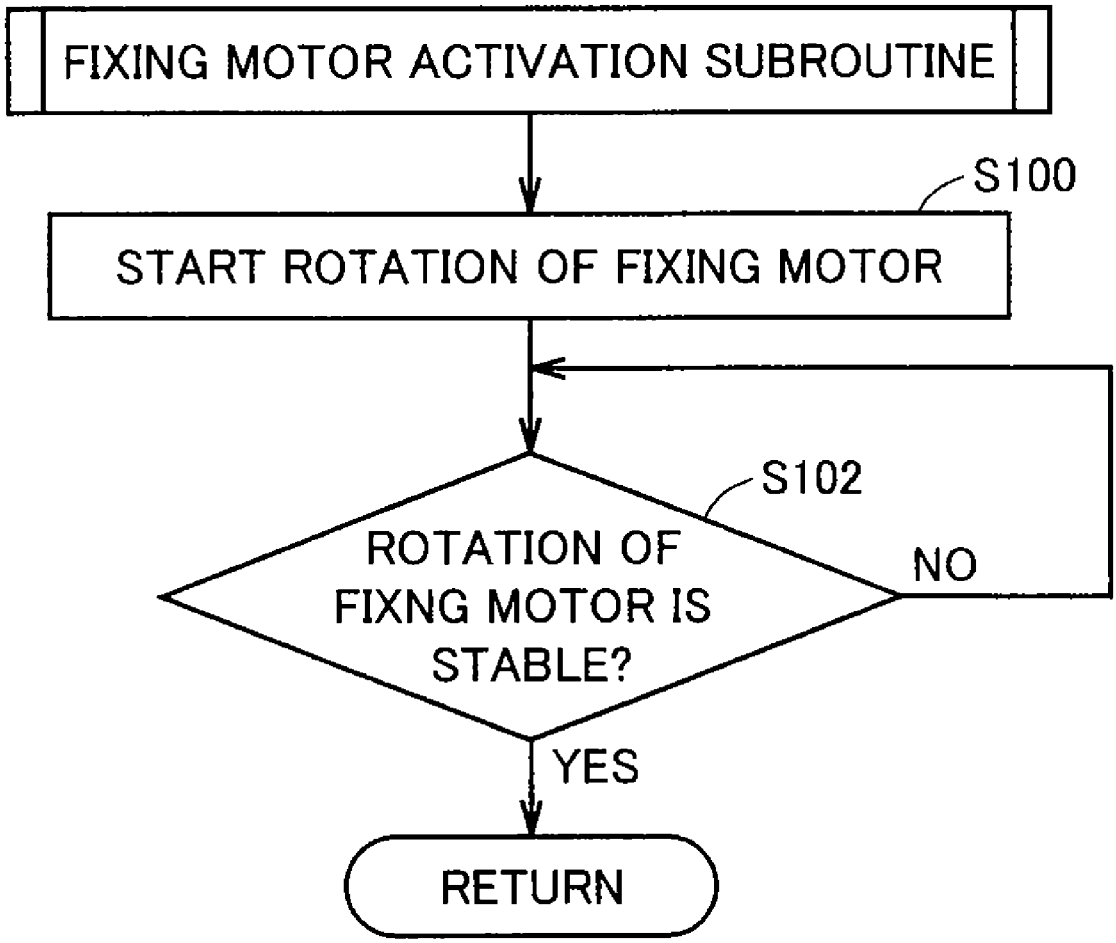
FIG. 9 is a flowchart showing a process procedure of a fixing motor activation subroutine in step S2 of the flowchart shown in FIG. 8.

Referring to FIG. 9, processing device 61 gives a rotation command to fixing motor 476 to start rotation of fixing motor 476 (step S1100). Then, processing device 61 determines whether or not the rotation of fixing motor 476 becomes stable (step S102). If the rotation of fixing motor 476 is not stable (NO in step S102), processing device 61 waits until the rotation of fixing motor 476 becomes stable.

On the other hand, if a motor lock signal is output from a sensor contained in fixing motor 476 or if a prescribed period (for example, 0.2-0.5[s]) elapsed since the start of rotation of fixing motor 476, processing device 61 assumes that the rotation of fixing motor 476 is stable. When the rotation of fixing motor 476 becomes stable (YES in step S102), the process proceeds to step S4 in FIG. 8.

Figure 10:
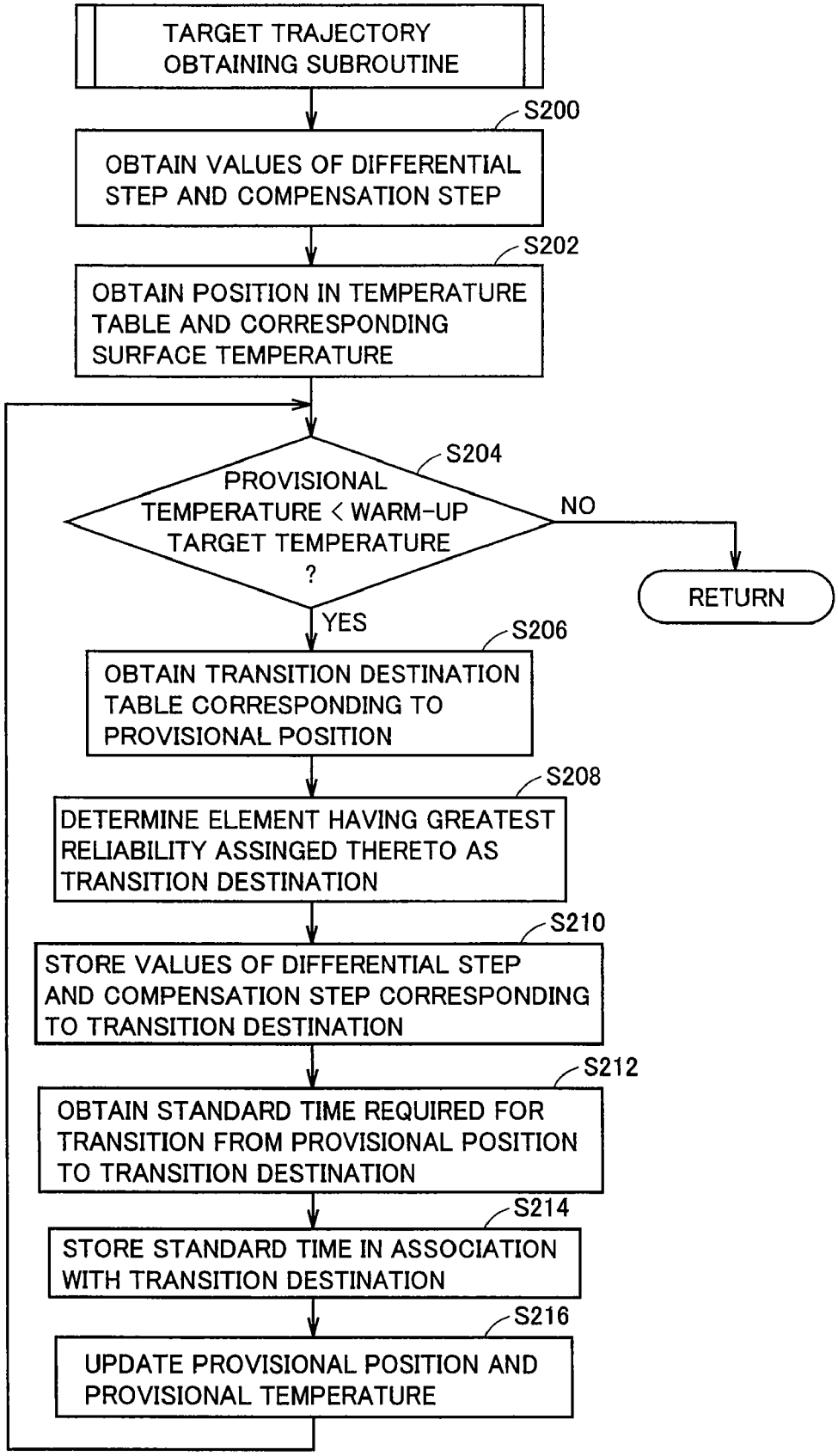
FIG. 10 is a flowchart showing a process procedure of a target trajectory obtaining subroutine in step S4 of the flowchart shown in FIG. 8.

Referring to FIG. 10, first, processing device 61 obtains the values of the differential step (the first input signal) and the compensation step (the second input signal) at present (step S200). Then, processing device 61 refers to temperature table 651 stored beforehand in storage portion 651 to obtain the position in temperature table 651 and the corresponding surface temperature for the obtained combination of the value of differential step and the value of compensation step (step S202). Here, processing device 61 sets the obtained position as a provisional position and also sets the obtained surface temperature as a provisional temperature. It is noted that the provisional position and the provisional temperature are variables used during the course of obtaining the target trajectory.

Next, processing device 61 determines whether or not the provisional temperature at present is less than the warm-up target temperature (step S204). If the provisional temperature at present is not less than the warm-up target temperature (NO in step S204), the process proceeds to step S6 in FIG. 8.

On the other hand, if the provisional temperature at present is less than the warm-up target temperature (YES in step S204), processing device 61 refers to storage portion 65 to obtain transition destination table 652 corresponding to the provisional position at present (step S206). Then, processing device 61 extracts an element to which the greatest reliability is assigned, of the reliability (at most, eight) stored in transition destination table 652 obtained in step S206, and determines the extracted element as the next transition destination (step S208). More specifically, processing device 61 determines as a target trajectory the transition to the element with the highest reliability, of the elements adjacent to the provisional position at present. Then, processing device 61 stores the values of the differential step (the first input signal) and the compensation step (the second input signal) corresponding to the next transition destination determined in step S208 into storage portion 65 (step S210). In addition, processing device 61 refers to transition time table 653 stored in storage portion 65 to obtain the standard time required for the transition from the provisional position at present to the next transition destination (step S212) and stores this standard time into storage portion 65 in association with the transition destination (step S214).

Then, processing device 61 updates the provisional position to the position of the next transition destination and also updates the provisional temperature to the corresponding surface temperature (step S216). Thereafter, the process after step S204 is executed again.

As described above, the process in steps S206-216 is repeated until the provisional temperature reaches the warm-up target temperature, whereby the target trajectory is stored in storage portion 65 in which the trajectory of two-dimensional data in temperature table 651 and the standard time required for the transition between the elements which appears in the trajectory are associated with each other.

Figure 11:
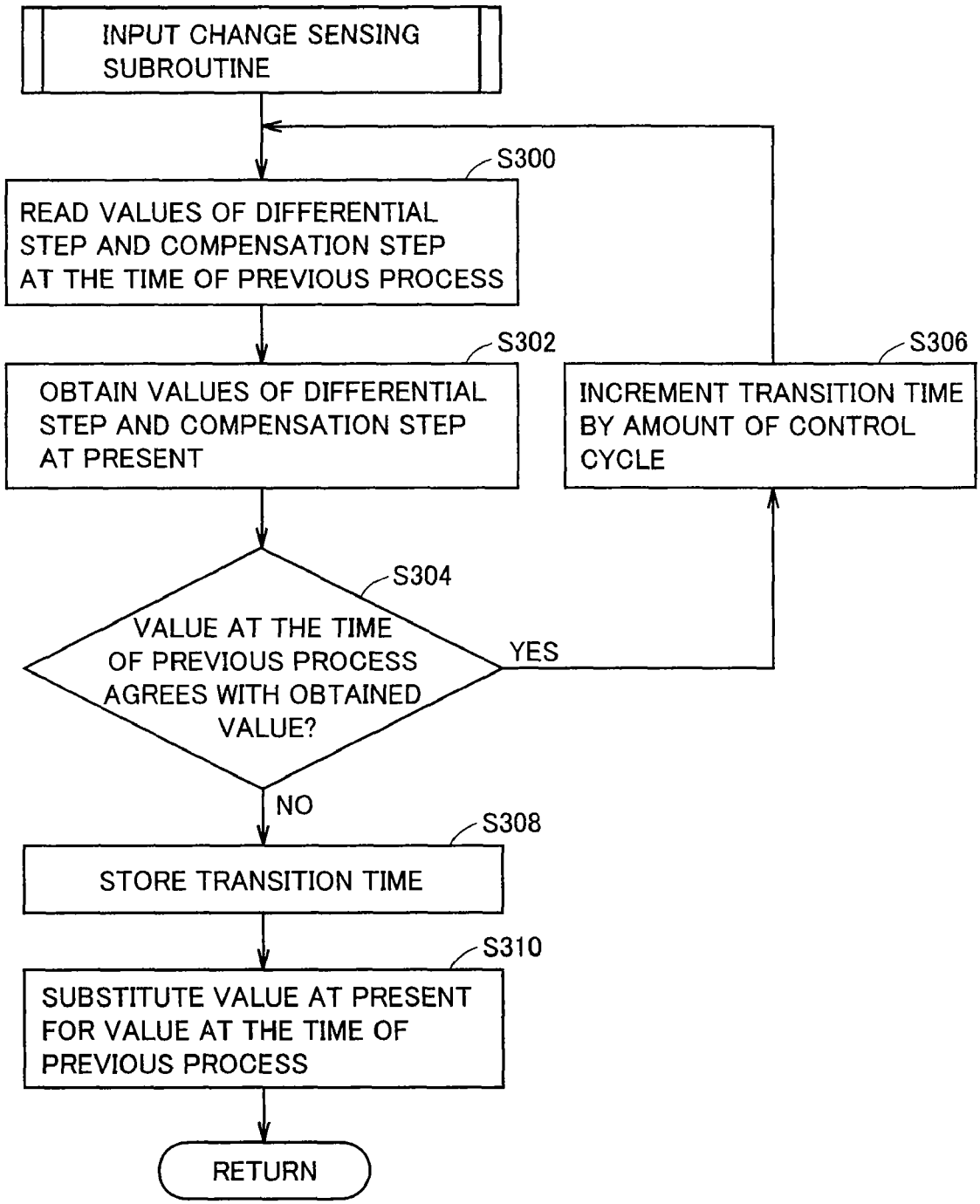
FIG. 11 is a flowchart showing a process procedure of an input change sensing subroutine in step S8 of the flowchart shown in FIG. 8.

Referring to FIG. 11, processing device 61 reads the values of the differential step (the first input signal) and the compensation step (the second input signal) at the time of the previous process (step S300). It is noted that these previous values are stored in storage portion 65 in the final process of this subroutine, as described later. Then, processing device 61 obtains the values of the differential step (the first input signal) and the compensation step (the second input signal) at present (step S302). Then, processing device 61 determines whether or not the values of the differential step and the compensation step at the time of the previous process as obtained in step S300 and the values of the differential step and the compensation step as obtained in step S302 are respectively the same (step S304). If the values of the differential step and the compensation step at the time of the previous process and the values of the differential step and the compensation step obtained in step S302 are respectively the same (YES in step S304), processing device 61 increments the transition time by an amount corresponding to the control cycle (step S306). Then, the process after step S300 is executed again.

On the other hand, if the values of the differential step and the compensation step at the time of the previous process and the values of the differential step and the compensation step obtained in step S302 are not the same (NO in step S304), processing device 61 temporarily stores the current (incremented) transition time into storage portion 65 (step S308) and in addition substitutes the values of the differential step and the compensation step at present for the values of the differential step and the compensation step at the time of the previous process, respectively (step S310). Then, the process proceeds to step S10 in FIG. 8.

It is noted that the sensing subroutine shown in FIG. 11 is preferably executed for each change of the differential step or the compensation step, and if the differential step and the compensation step change at the same time, the process is preferably executed twice corresponding to the change of each step.

Figure 12:
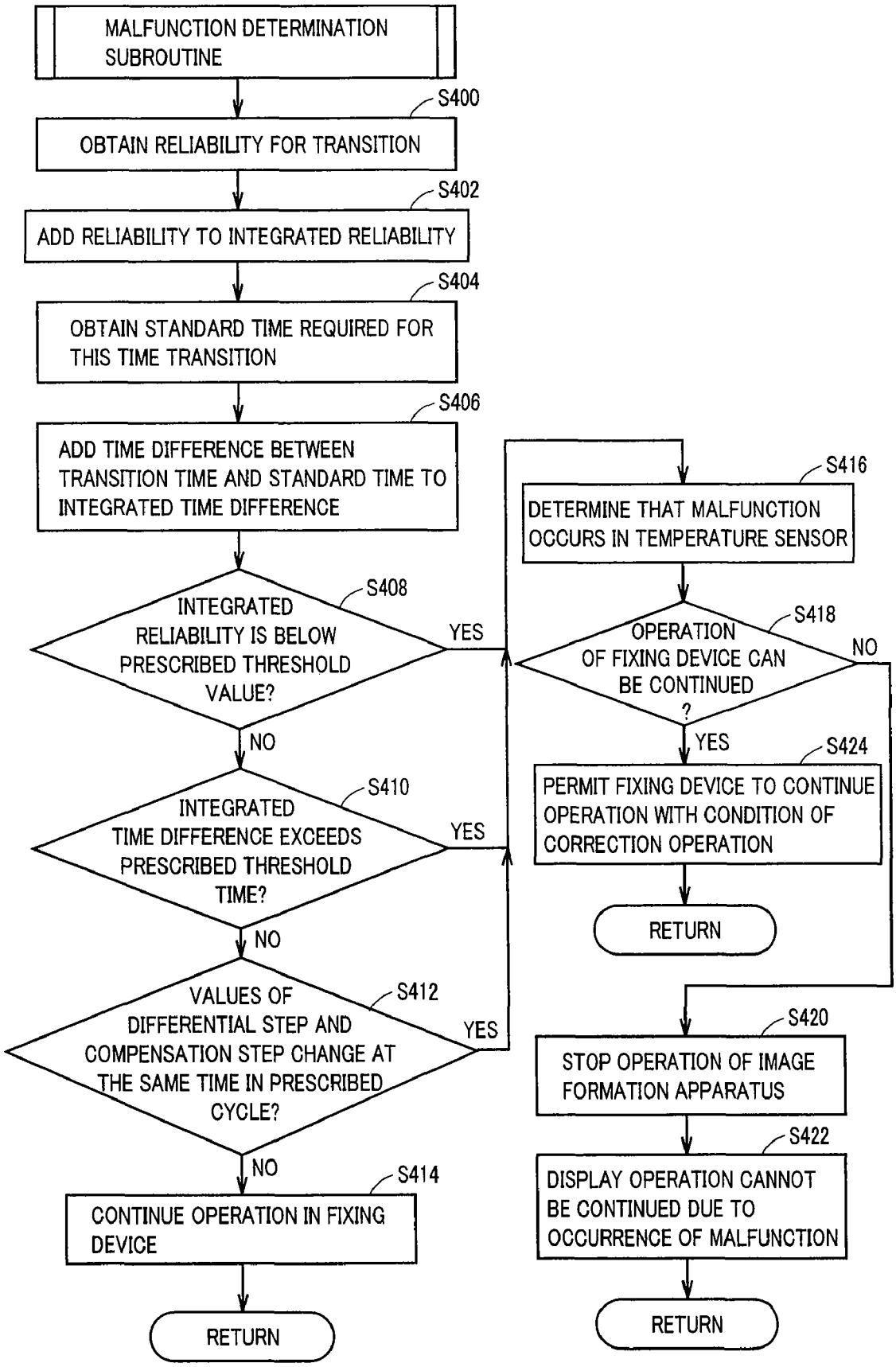
FIG. 12 is a flowchart showing a process procedure of a malfunction determination subroutine in step S10 of the flowchart shown in FIG. 8.

Referring to FIG. 12, first, processing device 61 refers to transition destination table 652 stored in storage portion 65 to obtain the reliability corresponding to the transition from the position of two-dimensional data (element) corresponding to the previous values of the differential step and the compensation step to the position of two-dimensional data corresponding to the present values of the differential step and the compensation step (step S400) and adds the obtained reliability to the integrated reliability (step S402). Here, the integrated reliability is a variable for integrating the reliability from the start to the end of the warm-up operation and is initialized (zero clear) at the start of the warm-up operation. It is noted that if the transition of two-dimensional data corresponds to the predetermined target trajectory, the reliability is "0" as described above and substantially noting is added to the integrated reliability.

Furthermore, processing device 61 refers to transition time table 653 stored in storage portion 65 to obtain the standard time required for the transition from the two-dimensional data (element) corresponding to the previous values of the differential step and the compensation step to the element corresponding to the present values of the differential step and the compensation step (step S404) ands adds the time difference between the transition time obtained in step S8 and this obtained standard time to the integrated time difference (step S406). Here, the integrated time difference is a variable for integrating the time differences from the start to the end of the warm-up operation and is initialized (zero clear) at the start of the warm-up operation.

In addition, processing device 61 determines whether or not the integrated reliability is below a prescribed threshold value (step S408). If the integrated reliability is not below a prescribed threshold value (NO in step S408), processing device 61 determines whether or not the integrated time difference exceeds a prescribed threshold time (step S410). If the integrated time difference does not exceed a prescribed threshold time (NO in step S410), processing device 61 determines whether or not the values of the differential step and the compensation step change at the same time in a prescribed period (step S412). Although the process is executed for each change of the differential step or the compensation step in the sensing subroutine shown in FIG. 11, it is necessary to sense that both values of the differential step and the compensation step change in this subroutine. Therefore, the control cycle of this subroutine is set relatively longer than the control cycle of the sensing subroutine shown in FIG. 11.

If the values of the differential step and the compensation step do not change at the same time (NO in step S412), processing device 61 determines that no malfunction occurs in roller temperature sensor 472 and ambient temperature sensor 473 and allows the operation in fixing device 47 to continue (step S414). Then, the process proceeds to step S12 in FIG. 8.

On the other hand, if the integrated reliability is below a prescribed threshold value (YES in step S408), if the integrated time difference exceeds a prescribed threshold time (YES in step S410), or if the values of the differential step and the compensation step change at the same time (YES in step S412), processing device 61 determines that malfunction occurs in roller temperature sensor 472 and/or ambient temperature sensor 473 (step S416). Then, processing device 61 determines whether or not the operation of fixing device 47 can be continued (step S418).

If it is determined that the operation of fixing device 47 cannot be continued (NO in step S418), processing device 61 stops the operation of image formation apparatus MFP (step S420) and also displays on a panel portion or the like that the operation cannot be continued due to occurrence of a malfunction (step S422). Then, the process proceeds to step S12 in FIG. 8.

On the other hand, if it is determined that the operation of fixing device 47 can be continued (YES in step S418), processing device 61 permits fixing device 47 to continue the operation, with the condition of a correction operation for the differential step and the compensation step (step S424). Then, the process proceeds to step S12 in FIG. 8. It is noted that the typical method of this correction operation is to shift the entire surface temperatures stored in temperature table 651, and therefore this correction operation is executed before the start of the next warm-up operation.

Figure 13:
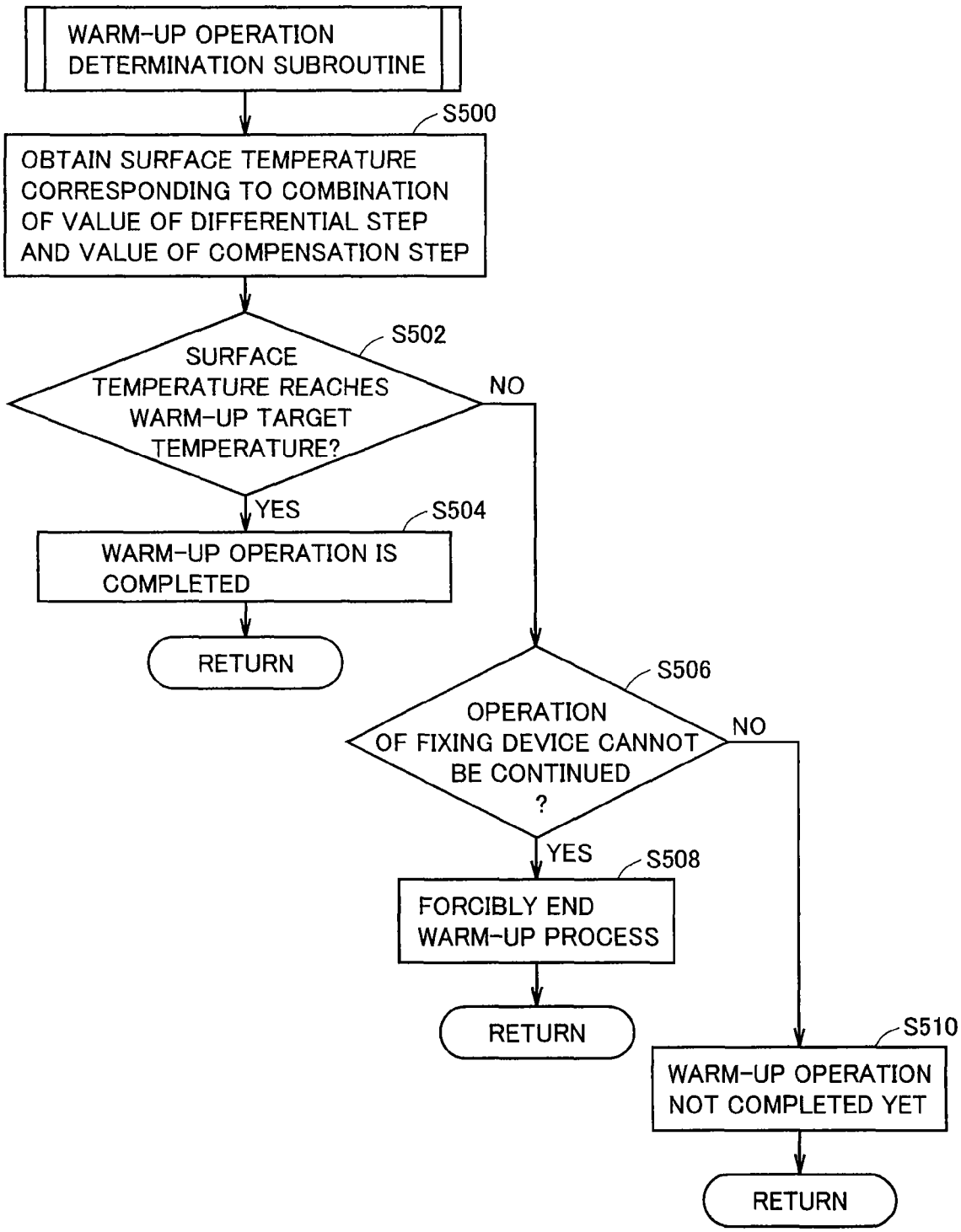
FIG. 13 is a flowchart showing a process procedure of a warm-up operation determination subroutine in step S12 of the flowchart shown in FIG. 8.

Referring to FIG. 13, processing device 61 refers to temperature table 651 to obtain the surface temperature corresponding to the combination of the value of the differential step and the value of the compensation step (step S500). Then, processing device 61 determines whether or not the obtained surface temperature reaches the target temperature of warm-up (step S502). If the obtained surface temperature reaches the target temperature of warm-up (YES in step S502), processing device 61 determines that the warm-up operation is completed (step S504). Then, the process proceeds to step S14 in FIG. 8.

On the other hand, if the obtained surface temperature does not reach the target temperature of warm-up (NO in step S502), processing device 61 determines whether or not it is determined that the operation of fixing device 47 cannot be continued in the process procedure of the malfunction determination subroutine shown in FIG. 12 (step S506). If it is determined that the operation of fixing device 47 cannot be continued (YES in step S506), processing device 61 forcibly ends the warm-up process (step S508).

If it is determined that the operation of fixing device 47 can be continued (NO in step S506), processing device 61 determines that the warm-up operation has not been completed yet (step S510), and the process proceeds to step S14 in FIG. 8.

Figure 14:
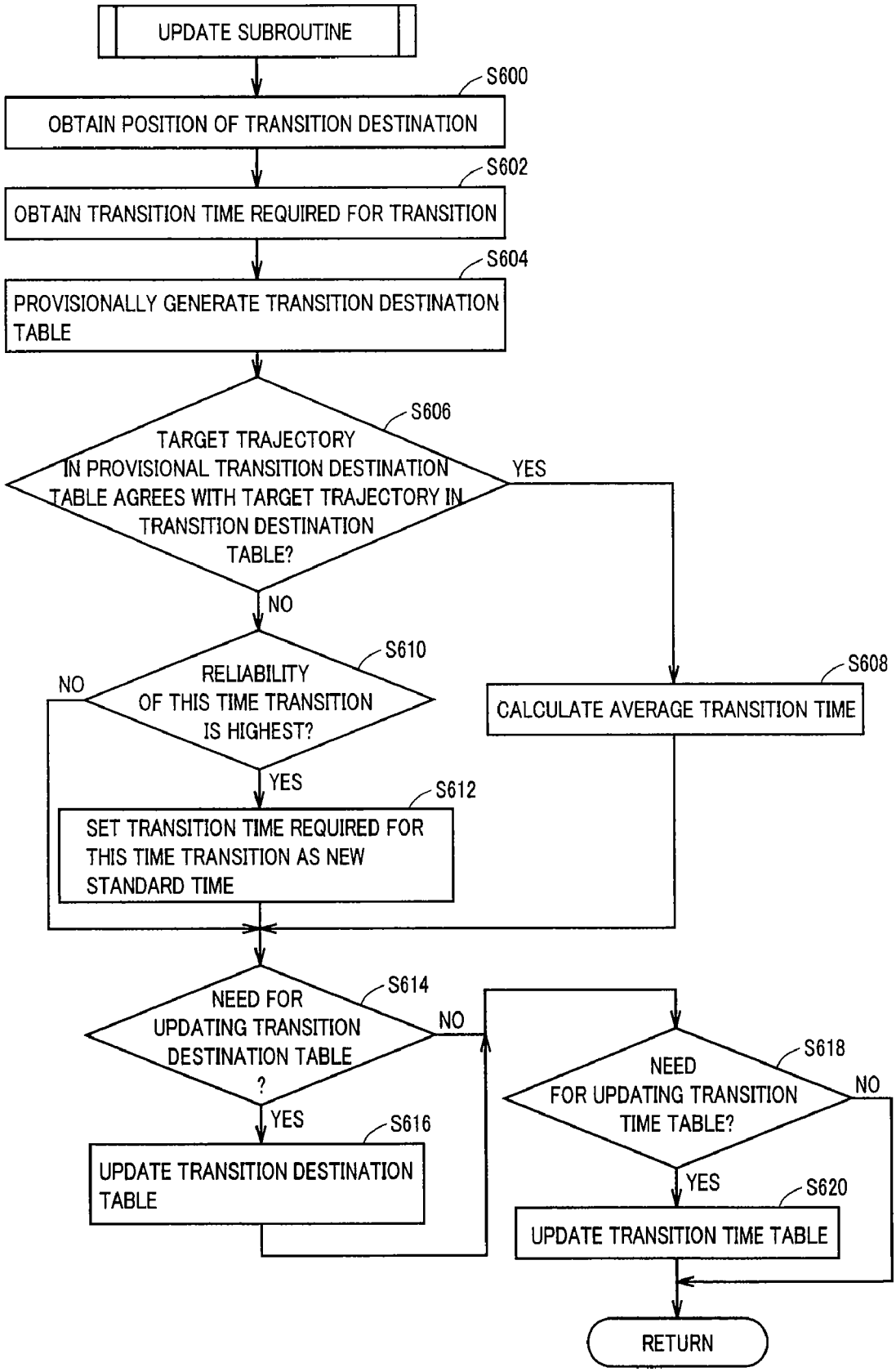
FIG. 14 is a flowchart showing a process procedure of an update subroutine in step S14 of the flowchart shown in FIG. 8.

Referring to FIG. 14, processing device 61 obtains the position of transition destination in temperature table 651 (step S600) and also obtains the transition time required for the transition this time (step S602). Then, processing device 61 averages the histories for N transitions in the past corresponding to this time transition and provisionally generates a corresponding transition destination table (step S604). Furthermore, processing device 61 refers to the corresponding transition destination table 652 stored in storage portion 65 to determine whether or not the target trajectory in the provisionally generated transition destination table agrees with the target trajectory in the corresponding transition destination table 652 stored in storage portion 65 (step S606).

If the target trajectory in the provisionally generated transition destination table agrees with the target trajectory in the corresponding transition destination table 652 stored in storage portion 65 (YES in step S606), processing device 61 calculates the average transition time by averaging the transition time required for N transitions in the past (step S608).

On the other hand, if the target trajectory in the provisionally generated transition destination table does not agree with the target trajectory in the corresponding transition destination table 652 stored in storage portion 65 (NO in step S606), processing device 61 determines whether or not the reliability of this time transition is highest in the provisionally generated transition destination table (step S610). If the reliability of this time transition is highest (YES in step S610), processing device 61 sets the transition time required for this time transition as a new standard time (step S612).

Then, after execution of step S608 or step S612 or if the reliability of this time transition is not highest (NO in step S610), processing device 61 determines whether or not there is need for updating the corresponding transition destination table (step S614). If there is need for updating the corresponding transition destination table (YES in step S614), processing device 61 updates the contents of storage portion 65 with the provisionally generated transition destination table set as a new transition destination table (step S616). In other words, if the target trajectory in the transition destination table provisionally generated in step S604 does not agree with the target trajectory in the corresponding transition destination table 652 stored in storage portion 65, processing device 61 updates the contents of the transition destination table.

Furthermore, processing device 61 determines whether or not there is need for updating the corresponding transition time table (step S618). If there is need for updating the corresponding transition time table (YES in step S618), processing device 61 updates the contents of the transition time table stored in storage portion 65 (step S620). In other word, if the transition time required for this time transition is set as a new standard time in step S612, processing device 61 updates the contents of the transition time table stored in storage portion 65 with this standard time.

Then, the process proceeds to step S16 in FIG. 8.

As described above, the warm-up operation in image formation apparatus MFP in accordance with the first embodiment of the present invention is executed in accordance with the process procedure shown in FIG. 8-FIG. 14.

In the present embodiment described above, whether or not a malfunction occurs in roller temperature sensor 472 and ambient temperature sensor 473 is determined based on the integrated value of reliability using transition destination table 652, and the integrated value of time difference between the time required for the transition between elements and the standard time using transition time table 653. However, whether a malfunction occurs or not may be determined only using one of the integrated value of reliability and the integrated value of time difference.

According to the first embodiment of the present invention, whether or not a malfunction occurs in each temperature sensor is determined based on the temporal behavior of two-dimensional data including the first input signal (differential step) and the second input signal (compensation step) obtained from the roller temperature sensor and the ambient temperature sensor. Therefore, it is possible to detect not only an irregular event such as no input from the temperature sensor due to disconnection but also an irregular event resulting from degradation of the temperature itself or the lowered detection accuracy due to attachment of dust, toner, paper dust or the like to the temperature sensor.

Moreover, the comparison of the actual trajectory of two-dimensional data with the target trajectory enables specification of the temperature sensor having malfunction and a correction operation according to this malfunction. Therefore, the image formation apparatus is allowed to continuously operate without requiring a repair operation by a user, a maintenance person, or the like.

[Second Embodiment]

In the foregoing first embodiment, image formation apparatus MFP employing the differential type temperature estimation method has been described. In the present embodiment, image formation apparatus MFP employing an independent type temperature estimation method will be described.

The schematic configuration of image formation apparatus MFP in accordance with the present embodiment is similar to the schematic configuration of image formation apparatus MFP in accordance with the first embodiment shown in FIG. 1 and therefore the detailed description will not be repeated.

Figure 15:
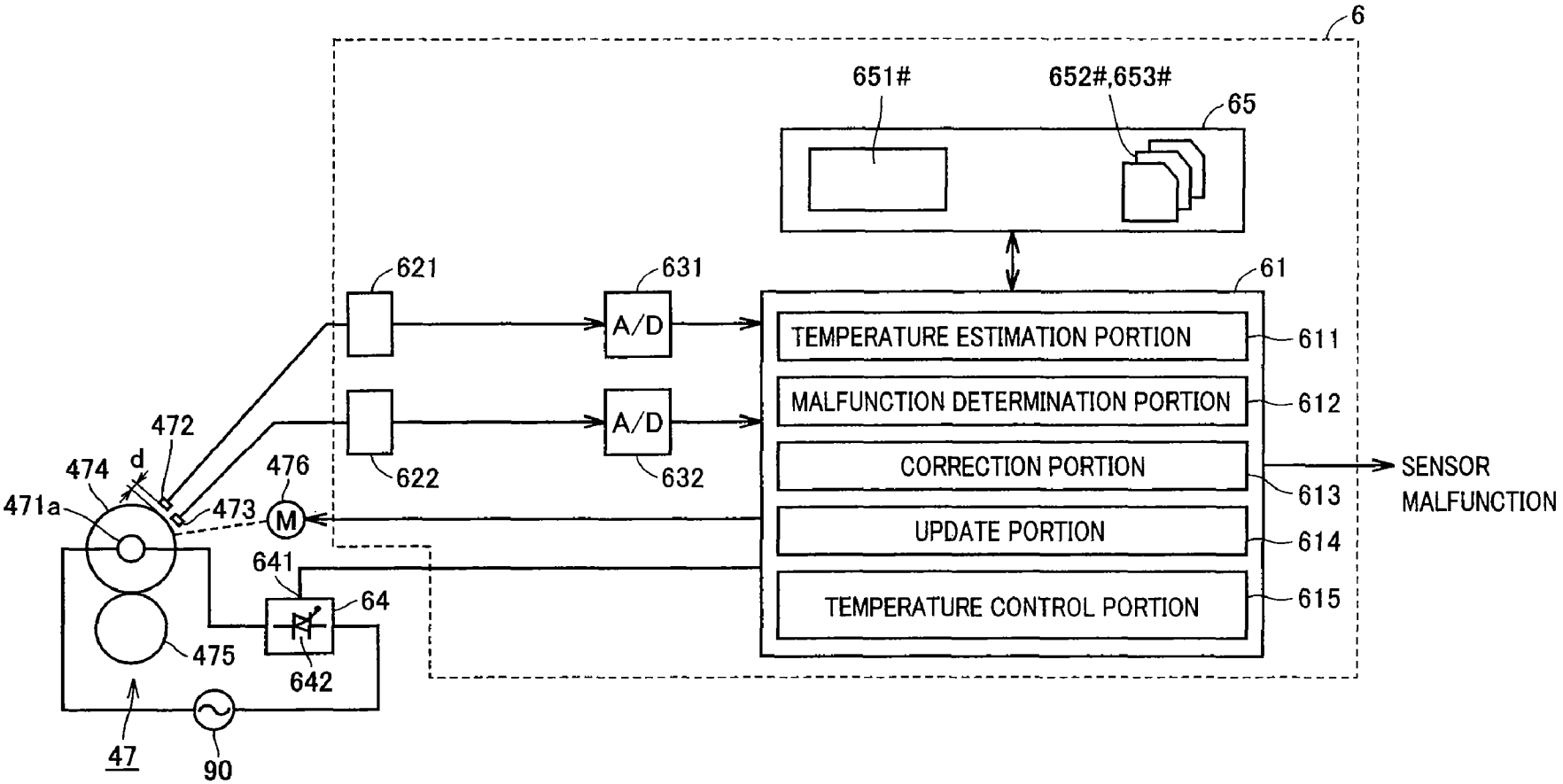
FIG. 15 is a diagram showing a control structure concerning the heat roller in the image formation apparatus in accordance with a second embodiment of the present invention.

Referring to FIG. 15, a control structure concerning heat roller 474 in accordance with the second embodiment of the present invention is formed by removing subtraction portion 623 in the control structure shown in FIG. 2 and storing a temperature table 651#, a transition destination table 652# and a transition time table 653# in storage portion 65, in place of temperature table 651, transition destination table 652 and transition time table 653. In other words, in image formation apparatus MFP in accordance with the present embodiment, a signal digitalized from an analog signal from roller temperature sensor 472 by A/D converter 631 is the first input signal (also referred to as "sensing step" hereinafter). Furthermore, a digital signal output from A/D converter 632 in response to an input of the sense signal of ambient temperature sensor 473 is the second input signal (also referred to as "compensation step" hereinafter).

Therefore, the data structure of temperature table 651# storing the surface temperature corresponding to a combination of the value of the first input signal and the value of the second input signal is also different from the data structure of temperature table 651 in accordance with the first embodiment. Accordingly, the data structures of a plurality of transition destination tables 652# and transition time tables 653# associated with each element of temperature table 651 are also respectively different from the data structures of transition destination table 652 and transition time table 653 in accordance with the first embodiment.

The other configuration is similar to that of image formation apparatus MFP in accordance with the first embodiment as described above and therefore the detailed description will not be repeated.

Referring to FIG. 16, in temperature table 651#, a surface temperature of heat roller 474 is defined beforehand in association with a combination of the sensing step as the first input signal and the compensation step as the second input signal. In temperature table 651#, a surface temperature of heat roller 474 is defined in association with two-dimensional data including the sensing step (the value of the first input signal) and the compensation step (the value of the second input signal). It is noted that the surface temperature of heat roller 474 in each element of temperature table 651# is empirically obtained beforehand.

Each element of temperature table 651# is determined in reflection of the detected temperature of heat (infrared radiation) radiating from heat roller 474 and the ambient temperature of the temperature itself, so that the surface temperature of heat roller 474 which is greatly affected by the ambient environment can be estimated appropriately.

Consider a case, as an example, where two dimensional data before the start of warm-up is Temp [6][7] (the surface temperature of heat roller 474 is 20° C.) and the target temperature of warm-up is 180° C. In this case, the two-dimensional data makes a transition over time in the order of Temp [6][6]→Temp [6][5]→Temp [5][4]→Temp [5][3]→Temp [4][2]→Temp [4][1] by the warm-up operation.

Here, dust, toner, paper dust or the like from a sheet frequently attaches to roller temperature sensor 472 and ambient temperature sensor 473. In addition, radiation heat from heat roller 474 may thermally degrade roller temperature sensor 472 and ambient temperature sensor 473. Then, similar to the first embodiment, the operation in a case where the temperature signals from roller temperatures sensor 472 and ambient temperature sensor 473 deviate from the values indicating the original temperature will be described. An exemplary operation in a case where the detection sensitivity of roller temperature sensor 472 is lowered because of attachment of dust, toner, paper dust or the like to roller temperature sensor 472 will be described as an example. Specifically, it is assumed that the temperature signal output from roller temperature sensor 472 is lowered by a prescribed level from the original level.

FIGS. 17A-17C are diagrams illustrating transition of two-dimensional data over time on temperature table 651# in the case where the detection sensitivity of roller temperature sensor 472 is lowered. Here, in FIGS. 17A-17C, the temperature signal from roller temperature sensor 472 is uniformly lowered and the value of the sensing step is lowered by a 1AD value from the original value, by way of example.

FIG. 17A is a diagram illustrating the target trajectory of the temperature control operation in temperature control portion 615. As shown in FIG. 17A, temperature control portion 615 performs temperature control such that the two-dimensional data on temperature table 651# makes a transition along the similar trajectory as the two-dimensional data shown in FIG. 16.

However, in actuality, the input value of compensation step is equivalent to the value obtained by subtracting 1AD value from the original value, so that the two-dimensional data on temperature table 651# makes a transition along the trajectory shown in FIG. 17B, for example. More specifically, in the state in which the detection sensitivity of roller temperature sensor 472 is lowered, the two-dimensional data makes a transition over time in the order of Temp [6][7]→Temp [6][6]→Temp [5][5]→Temp [5][4]→Temp [4][3]→Temp [4][2]→Temp [4][1]→Temp [4][0].

As a result, the surface temperature of heat roller 474 exceeds 180° C. which is the original target temperature and reaches as high as 200° C.

Next, the trajectory shown in FIG. 17A and the trajectory shown in FIG. 17B are overlapped as shown in FIG. 17C. Referring to FIG. 17C, there are two different points between the target trajectory shown in FIG. 17A and the actual trajectory shown in FIG. 17B.

Then, also in image formation apparatus MFP in accordance with the present embodiment, whether a malfunction occurs or not in roller temperature sensor 472 and ambient temperature sensor 473 is determined by comparing the trajectory (temporal behavior) actually created by the two-dimensional data on temperature table 651# with the target trajectory.

Figure 18:
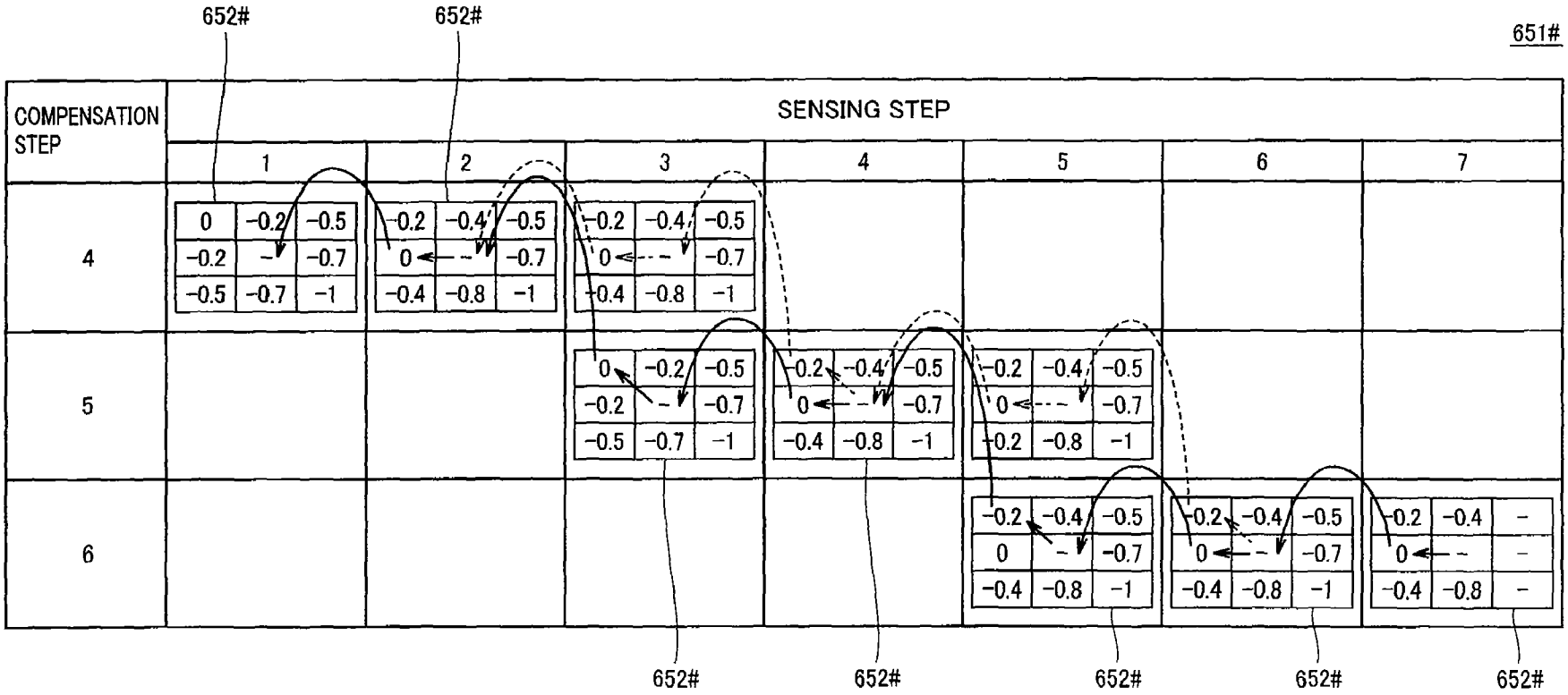
FIG. 18 is a diagram illustrating an integration process of reliability corresponding to a trajectory of two-dimensional data corresponding to FIGS. 17A-17C.

Referring to FIG. 18, first, each of transition destination tables 652# is associated with one element of temperature table 651# and is stored beforehand. Then, in each of transition destination tables 652#, the reliability for the transition from the corresponding element to the adjacent element is each defined. For example, in transition destination table 652 corresponding to Temp [6][7], the reliability for the total five transition destinations, Temp [5][7], Temp [5][6], Temp [6][6], Temp [7][6], Temp [7][7] adjacent to Temp [6][7] is defined. Then, the greatest value "0" in transition destination table 652# is assigned to the transition from Temp [6][7] to Temp [6][6] corresponding to the target trajectory, and the smaller values different from "0" are assigned to the other transitions. In other words, a non-zero negative value is assigned to the transition different from the target trajectory.

In this manner, malfunction determination portion 612 successively integrates the reliability according to the temporal behavior of two-dimensional data on temperature table 651# with reference to transition destination table 652#.

In this manner, malfunction determination portion 612 determines whether or not a malfunction occurs in roller temperature sensor 472 and ambient temperature sensor 473, based on the magnitude of the integrated reliability. Then, if it is determined that a malfunction occurs in roller temperature sensor 472 or ambient temperature sensor 473, malfunction determination portion 612 determines whether or not the operation of fixing device 47 can be continued. In other words, malfunction determination potion 612 corrects the occurring malfunction and then determines whether or not fixing device 47 can be continuously operated. Then, if it is determined that the operation of fixing device 47 cannot be continued, malfunction determination portion 612 stops the operation of image formation apparatus MFP and also displays on a not-shown panel portion or the like that the continuous operation is not allowed due to occurrence of malfunction. On the other hand, if it is determined that the operation of fixing device 47 can be continued, malfunction determination portion 612 allows correction portion 613 to execute a correction operation for the first input signal or the second input signal.

The other configuration is similar to that of image formation apparatus MFP in accordance with the first embodiment as described above and the detailed description will not be repeated.

According to the second embodiment of the present invention, the effect similar to the effect in the foregoing first embodiment can be achieved, and in addition, the temperature sensor in which malfunction occurs can be specified more easily since the first input signal and the second input signal respectively correspond to roller temperature sensor 472 and ambient temperature sensor 473.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image formation apparatus comprising:

a rotatable heat roller;

a first temperature sensor detecting a temperature at a position at a prescribed distance from a surface of said heat roller;

a second temperature sensor detecting an ambient temperature of said first temperature sensor;

a storage portion storing a temperature table in which a surface temperature of said heat roller is defined in association with a combination of a first input value and a second input value obtained by said first temperature sensor and said second temperature sensor, and a transition destination table in which a weight for a transition from each element to an adjacent element is defined in association with each element of said temperature table;

a temperature estimation portion estimating said surface temperature, in accordance with said temperature table, based on first and second input values;

a temperature increase portion increasing the temperature of said heat roller according to the estimated surface temperature of said heat roller; and a determination portion successively integrating said weight every time an element corresponding to a combination of said first input value and said second input value makes a transition to an adjacent element, during a temperature increase of said heat roller by said temperature increase portion, and determining whether a malfunction occurs or not in said first or second temperature sensor, based on said integrated weight.

2. The image formation apparatus according to claim 1, wherein in each said transition destination table, a weight for a transition corresponding to a reference temporal behavior is different from a weight for any other transition.

3. The image formation apparatus according to claim 1, further comprising a correction portion correcting said surface temperature stored in said temperature table, based on a characteristic feature of deviation of a temporal behavior of multidimensional data from a reference temporal behavior, when said determination portion determines that said first or second temperature sensor has a malfunction.

4. The image formation apparatus according to claim 3, wherein said correction portion specifies which of said first and second temperature sensors has a malfunction, based on the characteristic feature of deviation of the temporal behavior of said multidimensional data from a reference temporal behavior.

5. The image formation apparatus according to claim 1, further comprising a first update portion updating a weight of said transition destination table, based on a temporal behavior of the multidimensional data including said first and second input values during a temperature increase of said heat roller by said temperature increase portion.

6. An image formation apparatus comprising:

a rotatable heat roller;

a first temperature sensor detecting a temperature at a position at a prescribed distance from a surface of said heat roller;

a second temperature sensor detecting an ambient temperature of said first temperature sensor;

a storage portion storing a temperature table in which a surface temperature of said heat roller is defined in association with a combination of a first input value and a second input value obtained by said first temperature sensor and said second temperature sensor, and a transition time table in which a standard time required for a transition from each element to an adjacent element is defined, in association with each element of said temperature table;

a temperature estimation portion estimating a surface temperature, in accordance with said temperature table, based on first and second input values;

a temperature increase portion increasing the temperature of said heat roller according to the estimated surface temperature of said heat roller; and a determination portion successively integrating a time difference between a time taken for a transition of an element corresponding to said first and second input values and the standard time corresponding to the transition, during a temperature increase of said heat roller by said temperature increase portion, and determining whether a malfunction occurs or not in said first or second temperature sensor, based on the integrated time difference.

7. The image formation apparatus according to claim 6, further comprising an update portion updating the standard time of said transition time table, based on a temporal behavior of the multidimensional data including said first and second input values during a temperature increase of said heat roller by said temperature increase portion.

8. An image formation apparatus comprising:

a rotatable heat roller;

a first temperature sensor detecting a temperature at a position at a prescribed distance from a surface of said heat roller;

a second temperature sensor detecting an ambient temperature of said first temperature sensor;

a temperature estimation portion estimating a surface temperature of said heat roller, in accordance with a predetermined relation, based on first and second input values obtained from detected temperatures by said first and second temperature sensors, wherein said first input value is a temperature difference between a detected temperature by said first temperature sensor and a detected temperature by said second temperature sensor, and said second input value is a detected temperature by said second temperature sensor;

a temperature increase portion increasing the temperature of said heat roller according to the estimated surface temperature of said heat roller; and a determination portion determining whether a malfunction occurs or not in said first or second temperature sensor, based on a temporal behavior of multidimensional data including said first input value and said second input value during a temperature increase of said heat roller by said temperature increase portion.

9. A method for determining malfunction of a temperature sensor in an image formation apparatus, said image formation apparatus including:

a rotatable heat roller, a first temperature sensor detecting a temperature at a position at a prescribed distance from a surface of said heat roller, and a second temperature sensor detecting an ambient temperature of said first temperature sensor, a storage portion storing a temperature table in which a surface temperature of said heat roller is defined in association with a combination of a first input value and a second input value obtained by said first temperature sensor and said second temperature sensor, and a transition destination table in which a weight for a transition from each element to an adjacent element is defined in association with each element of said temperature table;

said method comprising the steps of:

obtaining first and second input values obtained from detected temperatures by said first and second temperature sensors;

estimating a surface temperature of said heat roller, in accordance with a predetermined relation, based on said first and second input values;

increasing the temperature of said heat roller according to the estimated surface temperature of said heat roller;

obtaining said first and second input values during a temperature increase of said heat roller; and successively integrating said weight every time an element corresponding to a combination of said first input value and said second input value makes a transition to an adjacent element, during a temperature increase of said heat roller by said temperature increase portion; and determining whether a malfunction occurs or not in said first or second temperature sensor, based on said integrated weight.

10. The method according to claim 9, wherein in each said transition destination table, a weight for a transition corresponding to a reference temporal behavior is different from a weight for any other transition.

11. The method according to claim 9, further comprising the step of correcting said surface temperature stored in said temperature table, based on a characteristic feature of deviation of a temporal behavior of multidimensional data from a reference temporal behavior, when it is determined that said first or second temperature sensor has a malfunction, in said step of determining whether a malfunction occurs or not.

12. The method according to claim 11, wherein said step of correcting includes the step of specifying which of said first and second temperature sensors has a malfunction, based on the characteristic feature of deviation of the temporal behavior of said multidimensional data from said reference temporal behavior.

13. The method according to claim 9, further comprising the step of updating a weight of said transition destination table, based on a temporal behavior of multidimensional data including said first and second input values during a temperature increase of said heat roller by said temperature increase portion.

14. A method for determining malfunction of a temperature sensor in an image formation apparatus, said image formation apparatus including a rotatable heat roller, a first temperature sensor detecting a temperature at a position at a prescribed distance from a surface of said heat roller, and a second temperature sensor detecting an ambient temperature of said first temperature sensor, a storage portion storing a temperature table in which a surface temperature of said heat roller is defined in association with a combination of a first input value and a second input value obtained by said first temperature sensor and said second temperature sensor, and a transition time table in which a standard time required for a transition from each element to an adjacent element is defined, in association with each element of said temperature table;

said method comprising the steps of:

obtaining first and second input values obtained from detected temperatures by said first and second temperature sensors;

estimating a surface temperature of said heat roller, in accordance with a predetermined relation, based on said first and second input values;

increasing the temperature of said heat roller according to the estimated surface temperature of said heat roller;

obtaining said first and second input values during a temperature increase of said heat roller; and successively integrating a time difference between a time taken for a transition of an element corresponding to said first and second input values and the standard time corresponding to the transition, during a temperature increase of said heat roller by said temperature increase portion, and determining whether a malfunction occurs in said first or second temperature sensor, based on the integrated time difference.

15. The method according to claim 14, further comprising the step of updating the standard time of said transition time table, based on a temporal behavior of multidimensional data including said first and second input values during a temperature increase of said heat roller by said temperature increase portion.

16. A method for determining malfunction of a temperature sensor in an image formation apparatus, said image formation apparatus including:

a rotatable heat roller, a first temperature sensor detecting a temperature at a position at a prescribed distance from a surface of said heat roller, and a second temperature sensor detecting an ambient temperature of said first temperature sensor, said method comprising the steps of:

obtaining first and second input values obtained from detected temperatures by said first and second temperature sensors;

estimating a surface temperature of said heat roller, in accordance with a predetermined relation, based on said first and second input values, wherein said first input value is a temperature difference between a detected temperature by said first temperature sensor and a detected temperature by said second temperature sensor, and said second input value is a detected temperature by said second temperature sensor;

increasing the temperature of said heat roller according to the estimated surface temperature of said heat roller;

obtaining said first and second input values during a temperature increase of said heat roller; and determining whether a malfunction occurs or not in said first or second temperature sensor, based on a temporal behavior of multidimensional data including said first input value and said second input value.

* * * * *